United States Patent [19]

Willman et al.

[11] Patent Number: 4,839,076

[45] Date of Patent: Jun. 13, 1989

[54] POUCHED THROUGH THE WASHER AND DRYER LAUNDRY ADDITIVE PRODUCT HAVING AT LEAST ONE WALL COMPRISED OF FINELY APERTURED POLYMERIC FILM

[75] Inventors: Kenneth W. Willman, Fairfield; June T. Brennock; David C. O'Neill, both of Cincinnati; Joan B. Szkutak, Fairfield, all of Ohio

[73] Assignee: The Procter & Gamble Company, Cincinnati, Ohio

[21] Appl. No.: 178,747

[22] Filed: Apr. 7, 1988

[51] Int. Cl.[4] ..... C11D 17/00

[52] U.S. Cl. ..... 252/90; 252/92; 252/93; 252/174; 206/0.5

[58] Field of Search ..... 252/90, 93, 92, 174; 206/0.5

[56] References Cited

U.S. PATENT DOCUMENTS

| | | | |
|---|---|---|---|
| 1,985,882 | 1/1935 | Adler | 206/56 |
| 2,137,243 | 11/1938 | Heyman | 99/77 |
| 2,377,118 | 5/1945 | Weisman | 99/77.1 |
| 2,470,851 | 5/1949 | Hermanson | 252/93 |
| 2,475,241 | 7/1949 | Hermanson | 206/0.5 |
| 3,055,496 | 9/1962 | Dunlap | 206/59 |
| 3,097,787 | 7/1963 | Schur | 229/53 |
| 3,196,827 | 7/1965 | Wurster et al. | 118/24 |
| 4,011,172 | 3/1977 | Marsan et al. | 252/187 R |
| 4,017,411 | 4/1977 | Diehl et al. | 252/186 |
| 4,114,284 | 9/1978 | Weber | 34/12 |
| 4,139,475 | 2/1979 | Schwadtke et al. | 252/8.6 |
| 4,188,304 | 2/1980 | Clarke et al. | 252/93 |
| 4,259,383 | 3/1981 | Eggensperger et al. | 428/72 |
| 4,348,293 | 9/1982 | Clarke et al. | 252/90 |
| 4,373,992 | 2/1983 | Bondoc | 162/145 |
| 4,374,747 | 2/1983 | Tai | 252/186.26 |
| 4,395,261 | 7/1983 | Lutz | 8/111 |
| 4,410,441 | 10/1983 | Davies et al. | 206/0.5 |
| 4,416,791 | 11/1983 | Haq | 252/90 |
| 4,421,235 | 12/1983 | Moriya | 206/524.2 |
| 4,433,783 | 2/1984 | Dickinson | 206/484 |
| 4,440,597 | 4/1984 | Wells et al. | 162/111 |
| 4,473,611 | 9/1984 | Haq | 428/190 |
| 4,485,133 | 11/1984 | Ohtsuka et al. | 428/35 |
| 4,487,791 | 12/1984 | Komatsu et al. | 428/35 |
| 4,515,703 | 5/1985 | Haq | 252/92 |
| 4,552,752 | 11/1985 | Amick | 424/21 |
| 4,555,354 | 11/1985 | Clarke et al. | 252/90 |
| 4,562,218 | 12/1985 | Fornadel et al. | 524/15 |
| 4,572,360 | 2/1986 | Woitzik | 206/0.5 |
| 4,605,123 | 8/1986 | Goodrum et al. | 206/0.5 |
| 4,609,518 | 9/1986 | Curro et al. | 264/504 |
| 4,629,643 | 12/1986 | Curro et al. | 428/131 |
| 4,638,907 | 1/1987 | Bedenk et al. | 206/0.5 |
| 4,659,496 | 4/1987 | Klemm et al. | 252/90 |
| 4,695,422 | 9/1987 | Curro et al. | 264/504 |
| 4,776,455 | 10/1988 | Anderson et al. | 206/0.5 |

FOREIGN PATENT DOCUMENTS

| | | |
|---|---|---|
| 18001/83 | 2/1984 | Australia . |
| 0011500 | 5/1980 | European Pat. Off. . |
| 0011501 | 5/1980 | European Pat. Off. . |
| 0011502 | 5/1980 | European Pat. Off. . |

*Primary Examiner*—Paul R. Michl
*Assistant Examiner*—Hoa Van Le
*Attorney, Agent, or Firm*—E. Kelly Linmann; John V. Gorman; Richard C. Witte

[57] ABSTRACT

A pouched through the washer and dryer laundry additive product having at least one of its walls constructed of finely apertured polymeric film. In a particularly preferred embodiment, both pouch walls are constructed of finely apertured polymeric film to permit substantially full dissolution and discharge of the washer additive contained in the pouch during the washing cycle, yet retain substantially all of the dryer additive until the product is transferred into an automatic clothes dryer along with the laundered textiles. Pouched through the washer and dryer laundry additive products of the present invention deliver a significantly greater quantity of dryer additive material onto the textiles being tumble dried when contrasted with comparably constructed pouches comprised entirely of nonwoven and/or paper material. Furthermore, pouched through the washer and dryer laundry additive products of the present invention accomplish the aforementioned objective without an accompanying increase in staining of the textiles by the dryer added materials. Subcombination dryer additive products which contain no washer additive, but which are capable of withstanding a wash cycle without adversely affecting their performance in the dryer are also disclosed.

28 Claims, 14 Drawing Sheets

POUCHED THROUGH THE WASHER AND DRYER LAUNDRY ADDITIVE PRODUCT HAVING AT LEAST ONE WALL COMPRISED OF FINELY APERTURED POLYMERIC FILM

TECHNICAL FIELD

The present invention has relation to an improved through the washer and dryer laundry additive product which can be introduced into the washer along with the textiles to be laundered and which can more efficiently deliver specific washer additives during the washing cycle and specific dryer additives during the drying cycle without further operator attention.

The present invention has further relation to such a through the washer and dryer laundry additive product which will permit substantially full dissolution and discharge of the washer additives during the wash cycle, but which will retain substantially all of the dryer additive until the product is transferred into an automatic clothes dryer along with the laundered textiles.

The present invention has further relation to a pouched through the washer and dryer laundry additive product wherein at least one surface of the pouch is comprised of a polymeric film having a multiplicity of apertures of substantially predetermined size.

The present invention has still further relation to such a pouched through the washer and dryer laundry additive product wherein the apertures in said polymeric film are sized to provide substantially uniform distribution of the softened dryer additive material onto the textiles with which the pouch comes in contact during the tumble drying cycle in an automatic clothes dryer without causing excessive staining of the textiles.

The present invention has further relation to such a pouched through the washer and dryer laundry additive product which, for comparable quantities of dryer additive material transferred onto the textiles being dried, exhibits a lower level of staining than that exhibited by comparably constructed pouched through the washer and dryer laundry products having pouches made of porous nonwoven and/or paper material.

BACKGROUND ART

Envelopes or sacks adapted to contain substances from which an infusion is to be made have been known in the art for some time. For example, U.S. Pat. No. 2,137,243, issued to Haymon on Nov. 22, 1938 discloses a closed envelope made from perforated cellulose sheets through which water is able to quickly and efficiently permeate to form an infusion comprised of hot water and ground coffee, tea leaves, or other substances which have constituents partly or wholly soluble in hot water.

U.S. Pat. No. 4,572,360, issued to Lischka, geb. Woitzik on Feb. 25, 1986 discloses another infusion package for bathing herbs. The latter package preferably comprises a pouch made of synthetic foil having perforations which form projections extending beyond one surface of the synthetic foil. Some of the projections are oriented toward the interior of the package, while others are oriented outwardly from the package. According to the teachings of this reference, the outwardly extending projections widen when the package sides are pressed together. Conversely, when the inside space of the herb package increases, the inwardly oriented projections are enlarged somewhat, while the outwardly oriented projections tend to close up. This produces a valve-action which allegedly produces a very homogeneous water flow through the inside space of the herb package. It is in this manner that the herbs impart their active substances into the water, yet remain within the pouch so that they can later be removed from the water bath without difficulty.

Still another infusion bag for particulated food or beverage products such as tea, coffee and the like is disclosed in U.S. Pat. No. 4,605,123 issued to Goodrum et al. on Aug. 12, 1986. The infusion bag of Goodrum et al. is constructed of a tube of perforated thermoplastic film or other porous material having a central product containing portion and flat end portions on each end thereof. The perforated thermoplastic film or other porous material has a multiplicity of minute holes or openings which are described as being sufficiently small in size to prevent migration of the particulated food product therethrough, yet sufficiently large in size and number to permit adequate fluid flow therethrough. Joining together of the flat end portions forms a flow through or dual container type infusion bag and a handle for extending over the side of a cup or pot.

The use of closed envelopes or sacks to add detergent composition to the wash water during an automatic laundering cycle are also generally known in the art. For example, U.S. Pat. No. 4,188,304 issued to Clark et al. on Feb. 12, 1980, discloses the use of a detergent product in particulate form housed within a closed, water insoluble bag which has a water sensitive seal. The contents of the bag are discharged during the wash cycle when the water sensitive seal opens upon contact with the wash water.

Water insoluble bags or envelopes containing a detergent composition and having a water permeable layer protected by a water soluble or water dispersible protective layer are also generally known in the art. See, for example, U.S. Pat. No. 4,348,293 issued to Clark et al. on Sept. 7, 1982. The water soluble or water dispersible material also serves to prevent dusting out of the detergent composition through the water permeable portion of the bag so long as the bag remains in a dry state.

U.S. Pat. No. 4,416,791 issued to Haq on Nov. 22, 1983, discloses another pouched detergent composition wherein the pouch is made from a packaging film comprising a base film which is at least partially water soluble and which carries on one side a protective layer of particulate inert plastic material having a high water repellency. The pouch is made so that the interior surface having the layer of particulate contacts the detergent composition. In use in the washing machine, the unprotected pouch surface is attacked by the wash liquor to release the contents, while the protective layer allegedly prevents attack of the interior of the package by the contents prior to use.

Other representative prior art products containing a detergent type material within an envelope which is capable of allowing the entry of water during the wash cycle and dispensing of the dissolved detergent are disclosed in U.S. Pat. No. 4,410,441 issued to Davies et al. on Oct. 18, 1983; U.S. Pat. No. 4,433,783 issued to Dickinson on Feb. 28, 1984; and U.S. Pat. No. 4,515,703 issued to Haq on May 7, 1985.

Pouched products for dispensing various types of laundry additives, such as softeners, anti-stats and bleaches during the drying cycle in an automatic clothes dryer are also known in the art. See, for example, U.S. Pat. No. 4,114,284 to Weber et al. disclosing a sachet consisting of a closed packet of semipermeable to gas plastic film containing an odor producing composition of a fragrant nature absorbed on an inert absorbent carrier; U.S. Pat. No. 4,139,475 issued to Schwadtke et al. on Feb. 13, 1979 disclosing a package comprised of film material and having a pillow-like form with one side impermeable to the aqueous additive substance contained therein and one side containing a multiplicity of slits through which the aqueous additive substance is distributed during the clothes drying cycle; and U.S. Pat. No. 4,395,261 issued to Lutz on July 26, 1983 wherein hydrogen peroxide is placed into a pouched type film container with a microporous, hydrophobic surface which is heated, whereby the hydrogen peroxide is vaporized and delivered to the interior of the dryer where it is available to bleach the textiles.

In addition to the foregoing patent references dealing primarily with washer only or dryer only type products, various types of products suitable for use through both the washer and dryer have recently been introduced to the market by at least two manufacturers of laundry products, one of these being The Procter & Gamble Company of Cincinnati, Ohio. For the most part, the products marketed by The Procter & Gamble Company have been comprised of a multi-compartmented envelope formed from a pair of porous layers comprised of paper or non-woven material. The compartments in the envelope typically encapsulate a particulate detergent and/or bleach composition and either a particulate or a printed form of a fabric softener/anti-stat. The detergent and bleach compositions are water soluble so that they can be dissolved in the wash water and dispensed in the washing machine, while the softener/anti-stat is substantially insoluble in water, but softens when exposed to the elevated temperatures normally encountered in an automatic clothes dryer.

Through the washer and dryer products of the type recently introduced by The Procter & Gamble Company offer the convenience of one step addition at the time the clothes are initially introduced into an automatic washing machine. The detergent composition is dissolved by the wash water during the washing cycle to form a wash liquor for cleansing and bleaching the textiles being laundered. The bleach composition (if present) is also dissolved by the wash water to provide a bleach solution for bleaching the articles during the wash cycle. The fabric softener/anti-stat, whether printed on one or more of the porous layers comprising the envelope or included as a particulate in one or more of the detergent containing compartments, remains substantially solid at the temperatures normally encountered during the wash cycle. If the softener/anti-stat is in particulate form, the particles are of sufficient size that they will not pass through the porous layers comprising the envelope during the wash cycle.

Upon completion of the washing cycle, the porous envelope, substantially emptied of detergent and bleach (if initially present), is transferred along with the laundered textiles into an automatic clothes dryer where the elevated temperatures employed during the drying cycle soften the fabric softener/anti-stat printed on or contained within the compartments of the porous envelope. The softened fabric softener/anti-stat material is thereafter distributed onto the textiles by repeated impact of the laundered textiles against the porous envelope during the tumble drying cycle.

While the aforementioned through the washer and dryer laundry additive products marketed by The Procter & Gamble Company have provided a marked advance over the prior art single function pouches used either for delivering detergent and/or bleach compositions in the washing cycle or dryer additive compositions in the drying cycle, it would nonetheless be desirable to increase the delivery efficiency for the dryer additive material without at the same time causing increased staining of the textiles to which the dryer additive is being applied.

OBJECTS OF THE INVENTION

Accordingly, it is an object of the present invention to provide an improved through the washer and dryer laundry additive product which can be introduced into the washer along with the textiles to be laundered and which can more efficiently deliver specific washer additives during the washing cycle and specific dryer additives during the drying cycle without further operator attention.

It is another object of the present invention to provide an improved through the washer and dryer laundry additive product which is capable of retaining substantially all of the washer additive and dryer additive initially placed therein prior to introduction of the product into the washing machine.

It is another object of the present invention to provide such a through the washer and dryer laundry additive product which will permit substantially full dissolution and discharge of the washer additives during the wash cycle, but which will retain substantially all of the dryer additive until the product is transferred into an automatic clothes dryer along with the laundered textiles.

It is another object of the present invention to provide such a through the washer and dryer laundry additive product wherein the dryer additive is comprised of a particulate material which is of substantially predetermined size which is substantially insoluble in water and which will remain in a substantially solid state at the temperatures encountered in a normal washing cycle, but which will soften when subjected to the elevated temperatures normally encountered in an automatic clothes dryer.

It is another object of the present invention to provide a pouched through the washer and dryer laundry additive product wherein at least one surface of the pouch is comprised of a polymeric film having a multiplicity of apertures of substantially predetermined size to ensure dissolution of the washer additive materials during the wash cycle, but which will substantially prevent the loss of the substantially water insoluble dryer additive materials during the wash cycle.

It is another object of the present invention to provide such a pouched through the washer and dryer laundry product wherein the apertures in said polymeric film are sized to provide substantially uniform distribution of the softened dryer additive material onto the textiles with which the pouch comes in contact during the tumble drying cycle in an automatic clothes dryer without causing excessive staining of said textiles.

It is another object of the present invention to provide such a pouched through the washer and dryer laundry additive product capable of delivering more of the dryer additive material initially contained within the pouch onto the textiles being dried without increasing the severity of textile staining when compared to a similarly constructed pouched through the washer and dryer laundry additive product initially containing an identical quantity of the same dryer additive material, but having a pouch constructed entirely of nonwoven and/or paper material.

It is still another object of the present invention to provide such a pouched through the washer and dryer laundry additive product which, for comparable quantities of dryer additive material transferred onto the textiles being dried, exhibits a lower level of staining than that exhibited by comparably constructed pouched through the washer and dryer laundry products having pouches made entirely of porous nonwoven and/or paper material, but initially containing a greater quantity of dryer additive material.

Finally, it is an object of the present invention to provide such a pouched through the washer and dryer laundry additive product having a pouch including at least one wall comprised of apertured polymeric film, said pouched product being capable of withstanding the mechanical stresses encountered during a normal washing cycle, the mechanical stresses encountered during a normal drying cycle and the thermal stresses induced not only by the wash water during the washing cycle, but also by the elevated temperatures of a normal drying cycle without premature failure of the pouch. This allows the apertures in the polymeric film to effectively meter the rate and hence the quantity of wash water entering and leaving the pouch throughout the wash cycle as well as the rate and hence the quantity of softened dryer additive material transferred onto the textiles being dried during the tumble drying cycle.

DISCLOSURE OF THE INVENTION

The present invention pertains, in a particularly preferred embodiment, to a pouched through the washer and dryer laundry additive product which can be inserted into an automatic washing machine along with a load of textiles to be laundered and which travels with the articles through both the washing and subsequent drying cycles without further attention by the operator. Through the washer and dryer laundry additive products of the present invention are preferably formed by encapsulating predetermined quantities of washer and dryer additives in particulate form between a pair of polymeric film layers. The polymeric film layers are sealed to one another, preferably by the application of heat and pressure, to form one or more discrete compartments. Each compartment preferably contains a particulate mixture comprised of water soluble washer additives and substantially water insoluble dryer additives.

The washer additives can comprise materials such as detergents, bleaches, softeners, anti-stats or the like. Dryer additives typically comprise fabric softeners, anti-stats, bleaches, fragrances or the like.

At least one of the compartment walls in each of the compartments comprising the pouched product contains a multiplicity of relatively small apertures of substantially uniform predetermined size. Particularly preferred apertured polymeric film webs are disclosed in commonly assigned U.S. Pat. No. 4,629,643 issued to Curro et al. on Dec. 16, 1986 and entitled MICROAPERTURED POLYMERIC WEB EXHIBITING SOFT AND SILKY TACTILE IMPRESSION, said commonly assigned patent being hereby incorporated herein by reference.

The bulk of the particulate washer additive material and the bulk of the particulate dryer additive material housed within the pouch exhibit particle sizes which are too large to pass through the apertures in the film so long as the pouched product is maintained in a substantially dry, unheated state. However, the apertures in the polymeric film are large enough to permit wash water to enter the interior of the pouch during the wash cycle and dissolve the water soluble washer additive materials which thereafter pass out of the pouch and into the washing machine to facilitate laundering and/or other treatment of the textiles.

The dryer additive particles remain substantially unaffected by the wash water, since they are substantially water insoluble and since they remain in a substantially solid state at the temperatures normally encountered during the wash cycle. Accordingly, the washer additive materials are effectively dissolved and distributed into the wash water during the various wash cycles, while the dryer additive particles remain within the pouch throughout the wash cycle.

The pouch containing only the dryer additive particles, which typically comprise a fabric softener or fabric softener/anti-stat, is transferred along with the laundered textiles into an automatic clothes dryer without further operator attention being required to initiate dispensing of the dryer additive materials. In the event a combination washer/dryer is employed, the pouch simply remains in the washer/dryer along with the laundered articles until the washing and drying processes have both been completed. The benefits of using a through the washer and dryer laundry additive product are particularly pronounced in the latter situation, since there is no need for the operator to be present when the machine completes the washing cycle and enters the drying cycle.

The particulate dryer additive materials remaining within the pouch are softened at the elevated temperatures normally encountered in an automatic clothes dryer, such that the softened dryer additive materials can be extruded through the relatively small apertures in the polymeric film pouch wall or walls in response to repeated impacts between the pouch and the textiles being dried during the tumble drying cycle. In general, the more the dryer additive materials are softened, the more easily they will pass through the relatively small apertures in the pouch wall or walls onto the textiles being dried.

Quite unexpectedly, it has been learned that pouched through the washer and dryer laundry additive products employing pouches having at least one wall comprised of finely apertured polymeric film significantly reduce the degree of textile staining typically encountered when identical quantities of these dryer additive materials are distributed in a dryer using pouches comprised entirely of porous non-woven material, porous paper material or combinations thereof. While not wishing to be bound, it is believed that the relatively small apertures of substantially predetermined size provide a more uniform metering-like distribution of the dryer additive materials onto the surfaces of the textiles being dried.

In addition, pouched through the washer and dryer laundry additive products including at least one pouch wall comprised of finely apertured polymeric film have been found to exhibit greater delivery efficiency of the dryer additive materials being dispensed than pouches comprised entirely of porous non-woven and/or paper materials. The latter phenomenon is believed to be due to the fact that the finely apertured polymeric film, unlike the porous nonwoven and/or paper materials, is substantially nonabsorbent. Therefore, it has little or no tendency to absorb any of the dryer additive materials.

This greater delivery efficiency and the more uniform distribution provided by polymeric film containing relatively small apertures of predetermined size permit the delivery of a greater total quantity of dryer additive material onto the textiles being dried without simultaneously increasing the staining tendency typically encountered with similarly constructed pouches having walls comprised entirely of porous nonwoven and/or paper materials. In the case of softener/ anti-stat dryer additives, the benefits are noticeably softer textile articles exhibiting less static cling without the increased staining which normally results when pouches comprised entirely of porous nonwoven and/or paper materials are employed as the delivery vehicle.

Alternatively, the improved delivery efficiency exhibited by pouched through the washer and dryer laundry additive products of the present invention can be utilized to provide substantial improvements in economy without sacrificing performance, i.e., pouched products of the present invention can deliver the same quantity of dryer additive materials onto the textiles being dried using a lesser initial quantity of dryer additive material in the pouch than would otherwise be required for a similarly constructed pouch made entirely from porous nonwoven and/or paper materials.

As will be appreciated by those skilled in the art, these unexpected improvements in delivery efficiency and uniformity of distribution of dryer additive mean that subcombinations of the present invention may also be practiced to considerable advantage, i.e., as pouched laundry additive products which are intended to distribute only dryer additive materials during the tumble drying cycle. An advantage of dryer additive products of the latter type over prior art dryer additive products is that they are capable of surviving the wash cycle. Accordingly, the user can, if he or she so desires, throw them into the washing machine along with the soiled laundry and allow them to travel through the wash cycle without adversely affecting their subsequent performance in the dryer. The use of a dryer additive material which can survive the wash cycle also permits greater flexibility in pouch design for through the washer and dryer products intended to distribute both washer additives and dryer additives, i.e., washer additives can be enclosed within one compartment and dryer additives in another compartment and the pouch walls of each compartment optimized to ensure distribution of each material during the appropriate cycle.

BRIEF DESCRIPTION OF THE DRAWINGS

While the specification concludes with claims particularly pointing out and distinctly claiming the present invention, it is believed the present invention will be better understood from the following description in which:

DETAILED DESCRIPTION OF THE INVENTION

Figure 1:
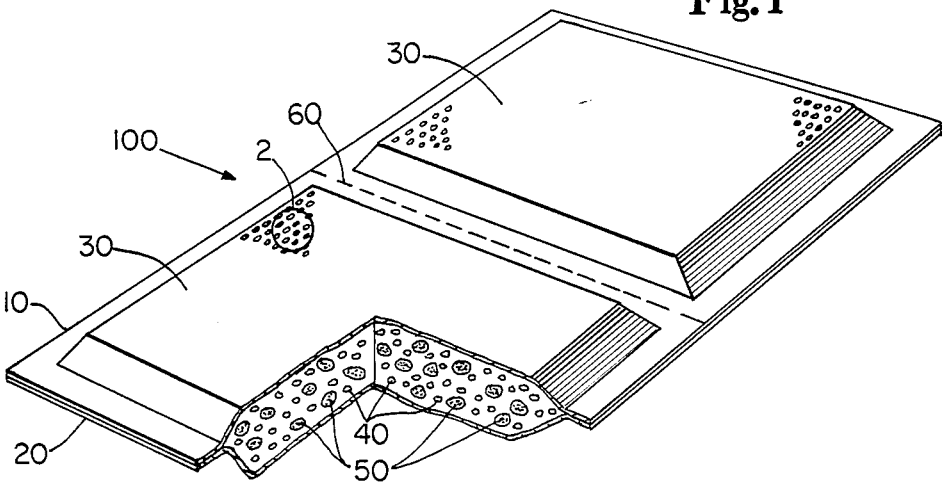
FIG. 1 is a simplified perspective illustration of a pouched through the washer and dryer laundry additive product configuration which can be employed in practicing the present invention.

In FIG. 1 there is shown a simplified perspective illustration of one possible configuration for a multifunction, unitized dose, through the washer and dryer laundry additive product 100. This configuration may be employed in practicing the present invention. The illustrated product 100 includes a pair of discrete compartments, each containing premeasured amounts of laundry cleaning and/or fabric care compositions which are particulate in form. The product 100 is intended to accompany the textiles to be laundered and dried throughout the washing and drying processes, releasing its various ingredients at the appropriate times and rates.

The benefits offered by the product 100 include convenience (no need for operator attention once the wash cycle is initiated; one compact package instead of separate, bulkier ones for each active; no measuring required; less mess) and better results via improved composition performance, since the amounts of ingredients can be tightly controlled and their time and rate of release can be more closely regulated than with manually dispensed bulk additions during the washing and drying cycles.

While the particular number of compartments employed is non-critical, e.g., a single compartment could be employed, the through the washer and dryer laundry additive product 100 illustrated in FIG. 1 includes two such discrete compartments 30 which are formed by sealing together an uppermost layer 10 comprised of a material which is pervious to water and a lowermost layer 20 about the periphery of the compartments. Lowermost layer 20 may be fluid pervious or fluid impervious, as desired, and may be comprised of the same or a different material than uppermost layer 10. In a particularly preferred embodiment, the sealing of uppermost layer 10 and lowermost layer 20 to one another is accomplished by the application of heat and pressure to the land areas about the perimeter of each of the compartments 30.

Each of the compartments 30 preferably contains a mixture comprised of a particulate detergent composition 40 and a particulate fabric softener/anti-stat composition 50. If desired, separate compartments could be used for each composition.

If desired, a line of weakness, such as line of perforations 60, may be provided intermediate the adjacent compartments 30 to facilitate separation of the product into two separate half-sized units to accommodate smaller than normal textile loads. In those embodiments wherein separate compartments are employed for each composition, the line of weakness could be used to separate the compartment(s) containing the detergent composition from the compartment(s) containing the softener/anti-stat composition. The latter feature would permit separate addition of either composition to a particular cycle without the need for subjecting the textiles being laundered to both treatments.

The primary technical requirements of the through the washer and dryer laundry additive product 100 are that the actives, i.e., the washer added detergent compositions 40 and dryer added softener/anti-stat compositions 50, be delivered to the consumer without significant loss through the fluid pervious wall or walls of the pouch prior to use; that the washer added particulate detergent composition be quickly and completely dissolved in the wash water and delivered to the washing machine early in the wash cycle; that the particulate dryer added softener/anti-stat be retained and protected throughout the wash cycle; and finally that the softener-/anti-stat composition be delivered as completely and as uniformly as possible onto the textiles which come in contact with the pouch during the tumble drying cycle with minimal staining of the textiles by the softener/anti-stat composition so delivered.

In the exemplary products to be described hereinafter, dual compartment pouches measuring approximately 4.3 inches by approximately 7.3 inches and having two identically sized compartments 30, divided by a heat seal, were constructed. Each compartment 30 contained substantially the same quantity and mixture of detergent particulate 40 and softener/anti-stat particulate 50. Using heat seals measuring approximately ¼ inch in width about each compartment 30, the net fluid pervious area of all of the pouch walls totalled approximately 23.9 square inches for those exemplary product embodiments wherein both uppermost layer 10 and lowermost layer 20 were comprised of fluid pervious material. The fluid pervious area totalled only approximately 11.95 square inches for those exemplary product embodiments employing a fluid-impervious lowermost layer 20.

The total volume of the pair of compartments 30 in the exemplary product embodiments was approximately 15.3 cubic inches, while the total volume occupied by the predetermined quantity of detergent particulate 40 (normally about 55 grams) and softener/anti-stat particulate 50 (either 2 grams or 4 grams, as specified with respect to each exemplary product embodiment) contained in the pair of compartments totalled between about 5.9 cubic inches (55 grams detergent plus 2 grams of softener/anti-stat) and about 6.1 cubic inches (55 grams detergent plus 4 grams of softener/anti-stat. This yielded a fill capacity of roughly 40 percent (ignoring the slight differences in volume for the two different levels of softener/anti-stat addition). The fill capacity was calculated by dividing the total volume of detergent particulate 40 (i.e., the volume occupied by 55 grams of particulate detergent) plus the maximum total volume of the softener/anti-stat particulate 50 (i.e., the volume occupied by 4 grams of particulate softener/anti-stat) by the total volume of the pair of compartments and multiplying the result by 100. In this regard it should be noted that completely filling the compartments 30 with detergent particulate 40 and softener/anti-stat particulate 50, i.e., 100% fill capacity, negatively impacts upon the solubility of the detergent particulate 40 during the wash cycle. Thus the 40 percent fill capacity employed in constructing most of the exemplary product embodiments was selected based upon the maximum which was permissible without negatively impacting upon the solubility of the particular detergent particulate used in making the exemplary products during the wash cycle. For different detergent compositions, the percent fill capacity may need to be adjusted upwardly or downwardly to find the optimum balance between percent fill capacity and detergent solubility.

In the event the particulate detergent composition 40 and the particulate softener/anti-stat composition 50 are housed in separate compartments, the optimum percent fill capacity for the detergent compartment(s) will not differ appreciably from product embodiments wherein the particulate additives are mixed with one another. This is due to the fact that the quantity of particulate softener/anti-stat is normally quite small relative to the quantity of particulate detergent composition 50. Since there is no need for water to enter a compartment containing only particulate softener/anti-stat, it is only necessary that such a compartment have sufficient surface area to permit substantially uniform distribution of the softener/anti-stat material onto the textile articles to be treated and sufficient volume and resistance to collapse to avoid excessive squeeze-out of the softener/anti-stat material when the pouch collides with the textile articles being tumble dried.

THE WASHER ADDITIVE

The particulate detergent composition 40 used in all of the exemplary product embodiments comprised a powdered laundry detergent made using spray drying techniques as generally described in the commonly assigned, allowed U.S. Patent Application of Hortel et al. entitled A SOIL-RELEASE POLYMER COATED SUBSTRATE CONTAINING A LAUNDRY DETERGENT FOR IMPROVED CLEANING PERFORMANCE, Ser. No. 017103, filed on 2/19/87, said commonly assigned application being hereby incorporated herein by reference. Its bulk density was about 8.8 gm/in$^3$, slightly higher than for typical boxed powders which are commercially available, in order to ease the compartment filling operation prior to sealing of the uppermost layer 10 and lowermost layer 20 to one another.

The target chemical makeup of the particulate detergent composition 40 used in the exemplary product embodiments hereinafter described was basically as follows:

| Ingredient | Weight Percent |
|---|---|
| Surfactant | |
| C13LAS | 9.5 |
| C14–15 AS | 9.5 |
| C12–13E 6.5T | 8.0 |
| Builder | |
| STPP | 31.4 |
| TSPP | 7.7 |
| Silicate (1.6R) | 6.6 |
| Buffer | |
| Sodium Carbonate | 10.2 |
| Enzyme | |
| Savinase 4.0T | 0.7 |
| Suds Control | |
| PEG 95% (by weight) Silicone 5% (by weight) | 0.4 |
| Other | |
| Polyacrylate (4500 MW) | 0.7 |
| PEG 8000 | 1.0 |
| Perfume | 0.2 |
| Brightener 15 | 0.5 |
| Sulfate and miscellaneous | 11.8 |
| Moisture | 8.0 |
| Total | 100.0 |

The particle size distribution for the powdered detergent composition 40 used in the exemplary product embodiments was basically as follows:

| Screen No. | Opening, as measured along the side of the square opening (inches) | % Retained |
|---|---|---|
| 14 | 0.0555 | 8 |
| 20 | 0.0331 | 16 |
| 25 | 0.0278 | 8 |
| 30 | 0.0234 | 12 |
| 35 | 0.0195 | 10 |
| 50 | 0.0117 | 24 |
| 70 | 0.0083 | 11 |
| 100 | 0.0059 | 6 |
| 140 | 0.0041 | 3 |
| solid pan (below all of the screens) | | 2 |
| | Total | 100 |

The foregoing particle size distribution was obtained using standard testing sieves, ASTM-E11 specification. The percentage retained listed for any given screen number signifies the percentage of granular material retained by that screen (after possibly passing through others).

THE DRYER ADDITIVE

The particulate softener/anti-stat 50 employed in the exemplary products hereinafter described was comprised of coated particles intended to impart both softening and static control benefits to the textiles during the tumble drying cycle.

The chemical makeup of the particulate softener/anti-stat 50 used in the exemplary product embodiments was basically as follows:

| Ingredient | Weight Percent |
|---|---|
| Ditallowdimethylammonium Methylsulfate (DTDMAMS) | 43.6 |
| Sorbitan Monostearate | 22.0 |
| Cetyl Alcohol | 22.0 |
| Bentonite Clay | 12.4 |

-continued

| Ingredient | Weight Percent |
|---|---|
| Total | 100.0 |

The softener/anti-stat was made by solidifying a mixture comprised of the foregoing materials and then running the resultant slab through a mill to create particles 50 which are sometimes called "prills", as is hereinafter described in greater detail. The DTDMAMS was heated in a reaction vessel at 71° Centigrade under vacuum (710 mm Hg) for 4 hours to remove residual moisture and/or isopropanol. The cetyl alcohol and sorbitan monostearate were then added, and the molten "triblend" was mixed for about one hour at a temperature of about 71° Centigrade.

The triblend was transferred into a PVM 40 Ross mixer (Charles Ross & Sons, Hauppauge, N.Y. 11788). The temperature of the triblend was then raised to between about 79° Centigrade and about 85° Centigrade under vacuum (about 330–430 mm Hg). When the temperature was stabilized in this range, the anchor and disperser on the Ross mixer were turned on and the clay was added. The mixture was blended for 5 minutes and then sheared with the Ross colloid mixer for about 20 minutes. The softener composition was then poured into trays and cooled overnight at about 4° Centigrade.

The solid softener core composition was then converted to particles by milling in a Fitzmill, Model DA 506 (The Fitzpatrick Company, Elmhurst, Ill. 60126) rotating at about 4740 rpm through a number 4 U.S. standard screen (square opening measuring 203 mils [0.203 inches] on a side). The particles were then sized through a number 12 U.S. standard screen (square opening measuring 67 mils [0.067 inches] on a side) onto a number 30 U.S. standard screen (square opening measuring 24 mils [0.024 inches] on a side).

These particles were then coated with a solution containing 9 parts ethyl cellulose and 1 part dibutyl sebacate in methanol at a concentration level of 10%. The ethyl cellulose used was ethocel Std. 4, (Dow Chemical Company, Midland, Mich. 48630) which has an Ubbelhhode viscosity of 3.0–5.5, measured at 25° Centigrade as a 5% solution in 80% toluene/20% ethanol. The aforementioned coating was applied in an 18 inch Wurster coater (Coating Place, Inc., P.O. Box 248, Verona, Wis. 53593). A detailed description of this type of equipment can be found in U.S. Pat. No. 3,196,827, issued to Wurster et al. on July 27, 1965, said patent being hereby incorporated herein by reference.

Briefly, the Wurster coater consists of an apparatus that is capable of suspending the softener core particles on a rapidly moving warm air stream. Encapsulation is accomplished by passing the softener particles through a zone of finely atomized droplets comprised of the coating material. As the particles move up and away from the coating nozzle, the coating begins to solidify as the solvent evaporates. When the particles can no longer be fluidized by the air stream, they move down in the opposite direction of the fluidizing air. The coated particles then reenter the coating zone and are recycled until the desired amount of coating is applied. The coating cycle takes place within a single chamber which preferably has a partition to separate the particles moving up through the coating zone from those moving down through the evaporative zone.

The following conditions were used to apply the coating:

| | |
|---|---|
| Fluidizing Air | 15.8 cu. meters/min. at 40.5 C. |
| Atomizing Air Volume | 0.37 cu. meters/min. |
| Atomizing Air Rate | 5624 g/sq. cm. |
| Inlet Air Temperature | 38° Centigrade-43° Centigrade |
| Outlet Air Temperature | 30° Centigrade-32° Centigrade |
| Pump Rate | 0.2 Kg/min. |
| Nozzle Size | CPI-18-A74* |
| Partition Size | 216 mm × 267 mm |
| Partition Gap | 19 mm |
| Run Time | 120 min. |

*Available from the Coating Place, Inc., P.O. Box 248, Verona, Wisconsin 53593.

The amount of ethyl cellulose/dibutyl sebacate solids coated onto the particles was about 5% by weight of the total coated particle weight. When the coating step was completed, the substantially water insoluble softener-/anti-stat particles were resized through a number 12 U.S. standard screen onto a number 30 U.S. standard screen. Those substantially water insoluble softener/anti-stat particles 50 which passed through the number 12 screen, but were retained on the number 30 screen were used to make the exemplary products described in the present specification.

To demonstrate the improved delivery efficiency and reduced staining tendency of pouched through the washer and dryer laundry additive products of the present invention relative to similarly constructed products made entirely from nonwoven and/or paper materials, Applicants made a series of exemplary product embodiments each employing the configuration of embodiment 100 generally shown in FIG. 1. Except as otherwise specifically noted, the variables employed in making the four exemplary pouched through the washer and dryer laundry additive product embodiments hereinafter described were limited to the materials of construction used for the pouches.

EXAMPLE I

The starting material employed to make the Example I pouched through the washer and dryer laundry additive products of the present invention comprised a 1 mil thick polypropylene film. The 1 mil thick polypropylene film was supported on a 100 filament × 100 filament woven wire mesh screen comprised of 4.5 mil diameter filaments in a square weave pattern. The film, supported on the woven wire, was subjected to a hydraulic forming process of the type generally described in commonly assigned U.S. Pat. No. 4,695,422 issued to Curro et al. on Sept. 22, 1987, which is hereby incorporated herein by reference.

Figure 2:
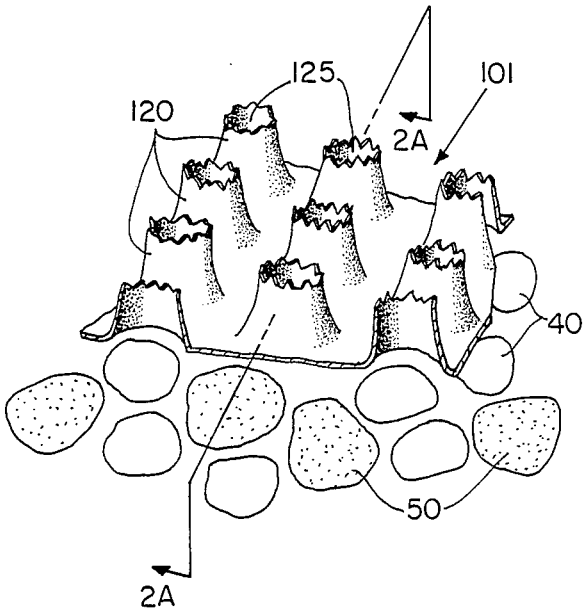
FIG. 2 is an enlarged, simplified, partially segmented perspective view of a particularly preferred finely apertured polymeric film which may be used to construct one or both walls of a pouched through the washer and dryer laundry additive product of the present invention, said view being taken at a point corresponding to inset 2 in FIG. 1.

The hydraulic forming process formed a conical protuberance 120 at each of the interstices in the woven wire support member, each of the protuberances exhibiting a small aperture 125 about 3.5 mils in diameter at its tip, as generally shown in FIG. 2. The result was a microapertured polymeric web 101 of the type generally disclosed in commonly assigned U.S. Pat. No. 4,629,643 issued to Curro et al. on Dec. 16, 1986, which patent is also incorporated herein by reference. The frequency of the microapertured protuberances 120 corresponded to the pattern of interstices in the 100 filament by 100 filament woven wire support member, thereby resulting in a regularly repeating pattern of approximately 10,000 such microapertured protuberances per square inch.

The products of Example 1 comprised a dual compartmented product having the configuration of product embodiment 100 shown in FIG. 1. They employed a layer of the aforementioned microapertured polymeric film 101 as both an uppermost layer 10 and a lowermost layer 20.

FIG. 2, which is a greatly enlarged, partially segmented view taken at a point corresponding to inset 2 in FIG. 1, shows the outward orientation of the protuberances 120 relative to the detergent particulate 40 and the softener/anti-stat particulate 50 contained within compartments 30. The lowermost layer of pouch material 20, also comprising a layer of microapertured polymeric film 101, had its protuberances 120 outwardly oriented relative to compartments 30.

Figure 2A:
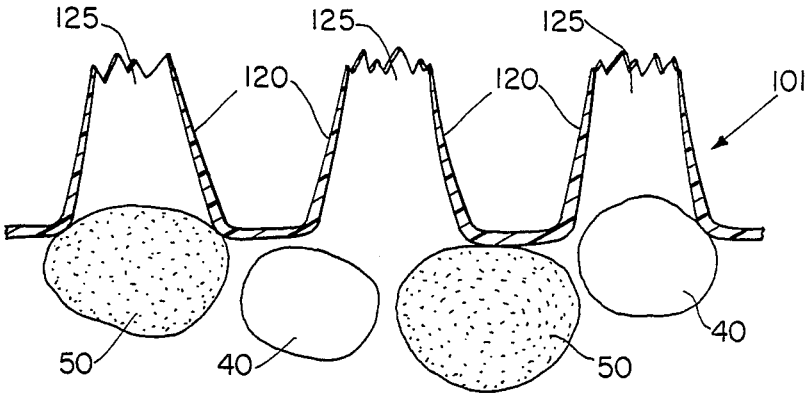
FIG. 2A is a further enlarged, simplified partial cross-section of the particularly preferred product shown in FIG. 2, said cross-section being taken at a point corresponding to section line 2A—2A in FIG. 2.

FIG. 2A is a simplified cross-sectional view taken along section line 2A—2A of FIG. 2. From FIG. 2A it is apparent that the microapertures 125 in the outwardly oriented protuberances 120 are sufficiently small that very little of the detergent particulate 40 and substantially none of the softener/anti-stat particulate 50 can pass therethrough so long as the particulates remain in a dry, substantially solid state.

In this regard it should be noted that the particle size distribution of the detergent composition 40, recited earlier in the present specification, was such that very few of the detergent particles were small enough to pass through an aperture measuring only about 3.5 mils in diameter. (Recall that only about 2 percent of the detergent particulate passed through a screen having a square opening measuring 4.1 mils [0.0041 inches] on a side.) Furthermore, the size of the softener/anti-stat particulate 50 used to make the Example I products was carefully controlled by running it through a number 12 U.S. standard screen (square opening measuring 67 mils [0.067 inches] on a side) and onto a number 30 U.S. standard screen (square opening measuring 24 mils [0.024 inches] on a side) following the coating operation.

To ensure that a particle placed within one of the Example I product compartments 30 will be retained it is only necessary that the particle be capable of fully enclosing at least one circle having a diameter which is greater than the maximum cross-sectional dimension of the microapertures 125 in the protuberances 120. In the case of the Example I product embodiments this meant that the bulk of the detergent particles 40 and softener-/anti-stat particles 50 had to be capable of fully enclosing at least one circle having a diameter greater than about 3.5 mils (0.0035 inches).

The microapertures 125, in addition to retaining the particulate detergent 40 and the particulate softener/anti-stat 50 while in a substantially dry, solid state must also permit water to enter the compartments 30 during wash cycle and dissolve the particulate detergent 40 contained therein. In addition, they must permit the dissolved wash liquor formed inside the compartments 30 to exit the compartments as quickly as possible so that the dissolved detergent composition can act upon the textiles being laundered for the longest possible time period. In this regard it has been observed that properly sized apertures which exhibit a substantially constant open area throughout the life of the product function well in this respect, while valve-like orifices, such as slits which exhibit a range of open areas throughout the life of the product, typically exhibit much higher levels of undissolved detergent at the conclusion of the washing cycle.

The exemplary product embodiments described herein were made using apertures 125 having a maximum cross-sectional dimension of about 3.5 mils in diameter. However, it has been found that workable products of the present invention containing the particular washer additive and dryer additives described herein can be made using films having either larger or smaller sized apertures. For example, films made from the same starting material on a 40×40 woven wire mesh comprised of 10 mil diameter filaments (maximum cross-sectional dimension of apertures in resultant film about 13.8 mils in diameter), 60×60 woven wire mesh comprised of 7.5 mil diameter filaments (maximum cross-sectional dimension of apertures in resultant film about 6.2 mils in diameter), 80×80 woven wire mesh comprised of 5.5 mil diameter filaments (maximum cross-sectional dimension of apertures in resultant film about 4.6 mils in diameter), and 120×120 woven wire mesh comprised of 3.7 mil diameter filaments (maximum cross-sectional dimension of apertures in resultant film about 2.7 mils in diameter) have been successfully tested. Although the larger sized apertures generally tend to promote quicker detergent dissolution, dusting of the detergent particulate through the walls tends to increase as the aperture size increases. Conversely, the smaller sized apertures are highly effective in minimizing dusting, but require longer times for dissolution of the detergent into the wash water. Interestingly, the delivery efficiency of the softener/anti-stat from the pouch and the textile staining tendency did not differ markedly over the range of aperture sizes tested.

As pointed out earlier herein, the particulate softener-/anti-stat 50 is preferably subjected to a fluidized bed spraying operation to provide a substantially water insoluble coating on the exterior of the particles 50. This prevents the wash water from acting to dissolve the softener/anti-stat particulate during the washing cycle.

The maximum temperature of the wash water employed in most U.S. homes is normally about 120° F. (49° C.). As described earlier herein, the softener/anti-stat particulate 50 is preferably formulated so that it begins to soften at a temperature which is greater than the maximum wash water temperature to be encountered. However, since distribution of the softener/anti-stat particulate 50 is intended to occur in the dryer, it is also necessary that the softener/anti-stat particulate 50 become sufficiently softened at temperatures which are normally encountered in the drying cycle so that the softened material can be extruded through the microapertured protuberances 120 in the sidewalls of compartments 30 in response to repeated collisions with the textile articles being tumble dried. Because the operating temperature of most automatic clothes dryers is normally at least about 150° F. (65° C.), the Example I products were formulated to begin softening at about 120° F. (49° C.) in order to survive the washing cycle yet soften during the drying cycle.

Each of the Example I dual compartment product embodiments of the present invention, contained a total of approximately 55 grams of particulate laundry detergent 40 and approximately 2 grams of particulate softener/anti-stat 50. The particulate detergent 40 and the particulate softener/anti-stat 50 were mixed substantially homogeneously prior to filling of the compartments, and the total quantity (approximately 57 grams) of homogeneously mixed detergent-softener/anti-stat particulate was divided approximately equally between the two discrete compartments 30.

The completed Example I product embodiments exhibited an appearance generally similar to that shown in FIGS. 1, 2 and 2A.

EXAMPLE II

A series of Example II product embodiments of the present invention which were, with one exception, identical to the Example I product embodiments was also constructed. The only difference between the Example II product embodiments and the Example I product embodiments was that the lowermost layer 20 which comprised an outwardly oriented microapertured polymeric film 101 in the Example I product embodiments was replaced with a layer of unapertured, substantially planar 1 mil thick polypropylene film. This of course reduced the apertured pouch wall area from approximately 23.9 square inches for the Example I product embodiments to approximately 11.95 square inches for the Example II product embodiments.

EXAMPLE III

The Example III product embodiments of the present invention were also, with one exception, generally the same as the Example I product embodiments. The difference was that the microapertured protuberances 120 in the polymeric film 101 comprising uppermost and lowermost layers 10,20 in the Example III product embodiments were inwardly oriented, i.e., uppermost layer 10 and lowermost layer 20 were secured to one another such that the protuberances 120 faced inwardly toward each other.

EXAMPLE IV

The Example IV product embodiments were constructed in a generally similar manner and configuration as product embodiment 100 illustrated in FIG. 1 to permit a comparison of products employing at least one wall comprised of finely apertured polymeric film with otherwise identical products constructed entirely of a porous nonwoven material. The uppermost layer 10 and lowermost layer 20 of the Example IV product embodiments were both comprised of a nonwoven material similar to that utilized in certain of the through the washer and dryer products currently being marketed by The Procter & Gamble Company of Cincinnati, Ohio. In particular, the Example IV product embodiments employed identical layers 10,20 comprised of a 1.3 oz. per square yard, thermobonded, carded nonwoven material, comprised of 3 denier polyester/polypropylene bicomponent fibers, as manufactured by the James River Corporation of Richmond, Va. The nonwoven layers were sealed to one another about the periphery of compartments 30 using heat and pressure. An identical quantity of detergent particulate 40 (i.e., a total of 55 grams) was included in the dual compartments 30 of the Example IV product embodiments. However, twice the amount of softener/anti-stat particulate 50 (i.e., 4 grams instead of 2 grams) was included in the dual compartments 30 of the Example IV product embodiments. This was necessary to provide a noticeable level of softening and anti-static benefits in the treated textile articles.

TEST DESCRIPTIONS

There are normally three primary areas of concern for the consumer who elects to employ a through the washer and dryer laundry additive product in lieu of conventional manually added bulk products. First, the product must be in good shape when acquired by the consumer. Second, washer performance (e.g. cleaning) must meet or exceed expectations relative to the conventional manual addition of bulk detergents. Finally, dryer performance must at least be on a par with conventional dryer only laundry additive products. The descriptions of laboratory tests hereinafter set forth are intended to follow these three general areas of concern.

Because of the wide variety of laundering conditions a through the washer and dryer laundry additive product may encounter (different machines, water temperatures and chemistry, machine cycles, clothing loads, soils, etc.) it is not practical to define a "representative" or an "average" situation. Therefore it is not suggested that the conditions of testing described hereinafter are necessarily "representative" or "average". Rather, it is intended that the test conditions be substantially the same for the various products tested so that any differences in performance may be accurately assessed.

Furthermore, investigation of active performance, i.e., the washer additive and the dryer additive, may require that products be evaluated not only at the end of the process cycle, but also at various stages of the process cycle, perhaps even under extreme conditions. In some instances, it may also be necessary to modify the product being subjected to testing to accurately measure the effect of a particular variable on overall performance. For the foregoing reasons, not all of the tests described hereinafter utilize exemplary products employing both actives. Similarly, not all of the tests described hereinafter employ complete washing and drying cycles.

The three basic categories of testing undertaken to compare pouched through the washer and dryer laundry additive products including at least one sidewall comprised of finely apertured polymeric film with similarly constructed pouched through the washer and dryer laundry additive products formed entirely of porous nonwoven material were:

(A) Dusting Performance;
(B) Washer Performance; and
(C) Dryer Performance.

A. DUSTING PERFORMANCE

The relatively-smaller size of some of the detergent particles 40 versus the softener/anti-stat particles 50 renders the former an object of concern for leakage out of the the product pouch prior to use. Two issues are addressed: dusting which occurs before consumer possession (e.g. on the manufacturing line, in shipment, etc.), and dusting which occurs during consumer handling. The former tendency is measured by subjecting the product in question to a test procedure hereinafter called "SHIP TESTING", while the latter tendency is measured by subjecting the product to a test procedure hereinafter called "DROP TESTING".

SHIP TESTING

This test estimates the leakage a product might experience during shipment from the converting line to the home.

Because loss of the relatively large softener/anti-stat particulate 50 does not normally occur in this test, the exemplary products subjected to ship testing did not include any softener/anti-stat particulate 50 in their compartments 30. However, the exemplary products subjected to ship testing were in all other respects identical to either those of Example I or those or Example IV.

All of the exemplary dual compartment products subjected to ship testing were filled with a total of 55 grams of detergent particulate 40 and packed into an 8-count carton. Sixteen of the 8-count cartons were thereafter placed inside a corrugated shipping case and the case was sealed as it would normally be for shipment. The shipping case was then placed on on a Gaynes Model 6000Z vibratory stand as available from Gaynes Engineering Company of Chicago, Ill. The filled corrugated shipping case was provided with three inches of lateral clearance on the deck of the vibratory stand to simulate movement which might occur during routine shipping operations. The filled corrugated case was shaken for a period of five minutes at a setting of 200 rpm.

The particulate detergent found in the bottom of the 8-count test carton at the conclusion of the vibration test was then weighed. The result in grams of detergent lost on one such test for each type of exemplary product were as follows:

| Product Type | Grams of Detergent Lost | Percent Loss |
|---|---|---|
| Product identical to Example I embodiments, but not including any softener/anti-stat particulate | 0.13 | 0.24 |
| Product identical to Example IV embodiments, but not including any softener/anti-stat particulate | 0.01 | 0.01 |

Experience has generally shown that dusting losses less than about 0.5 grams are generally not found to be objectionable by most consumers, nor are they sufficient to adversely affect cleaning performance. While the exemplary product embodiments generally similar to those of Example I did exhibit a greater quantity of detergent loss than the product embodiments similar to those of Example IV during the simulated ship testing, the total amount of detergent loss for either product was well below the aforementioned 0.5 gram limit.

DROP TESTING

This test estimates the leakage a consumer may experience during manual handling of an individual product. Again, because dusting of the relatively larger softener/anti-stat particles does not normally occur when products containing the softener/anti-stat particulate are subjected to this test procedure, none of the exemplary products subjected to drop testing included any of the softener/anti-stat particulate 50.

Exemplary products in all other respects identical to either those of Example I or those of Example IV were filled with 55 grams of detergent and dropped from a height of two feet onto a black swatch of cloth superimposed on a hard surface. The resultant "footprint" of dust is assigned an ordinal grade according to the set of standardized photographs shown in FIGS. 4 to 4D.

Figure 4:
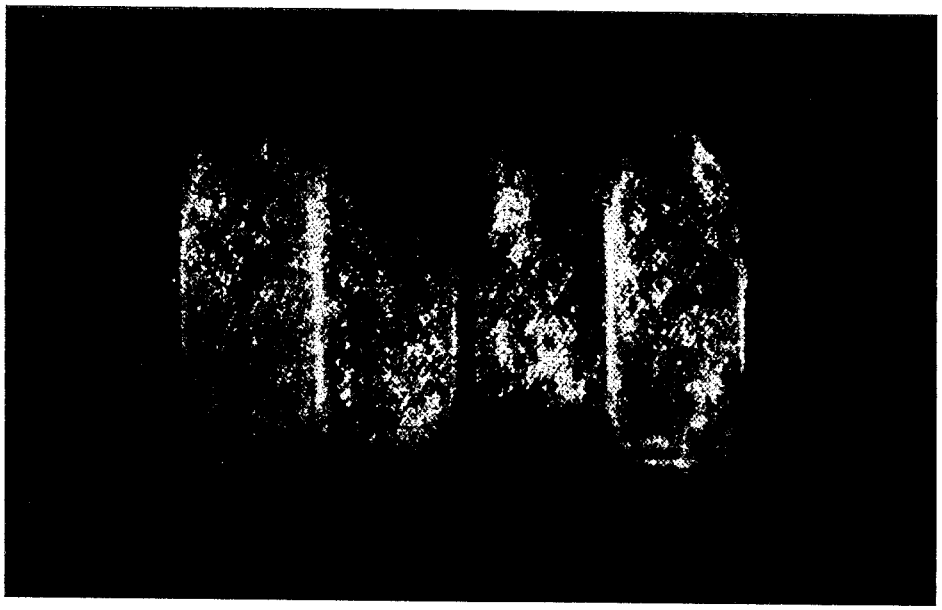
FIGS. 4A, 4B, 4C and 4D comprise a series of photographs used as a calibration to grade the tendency of the laundry additive products tested to dust when subjected to drop testing prior to use in an automatic washing machine.
Figure 4A:
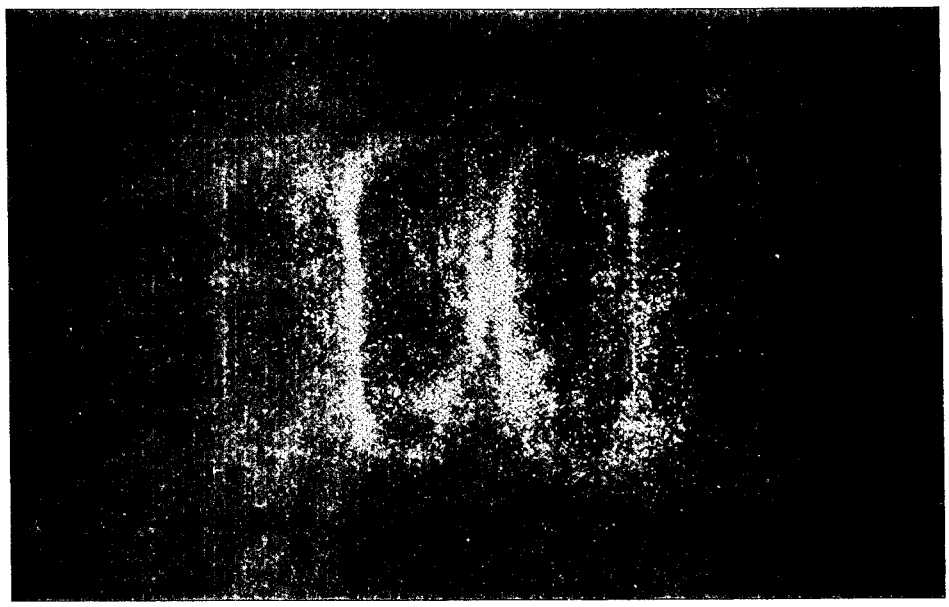
Figure 4B:
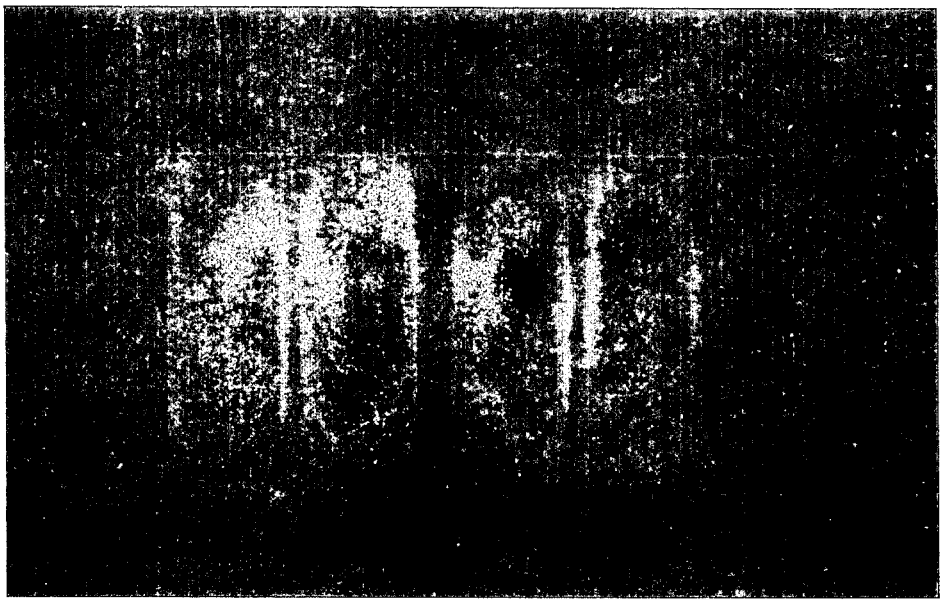
Figure 4C:
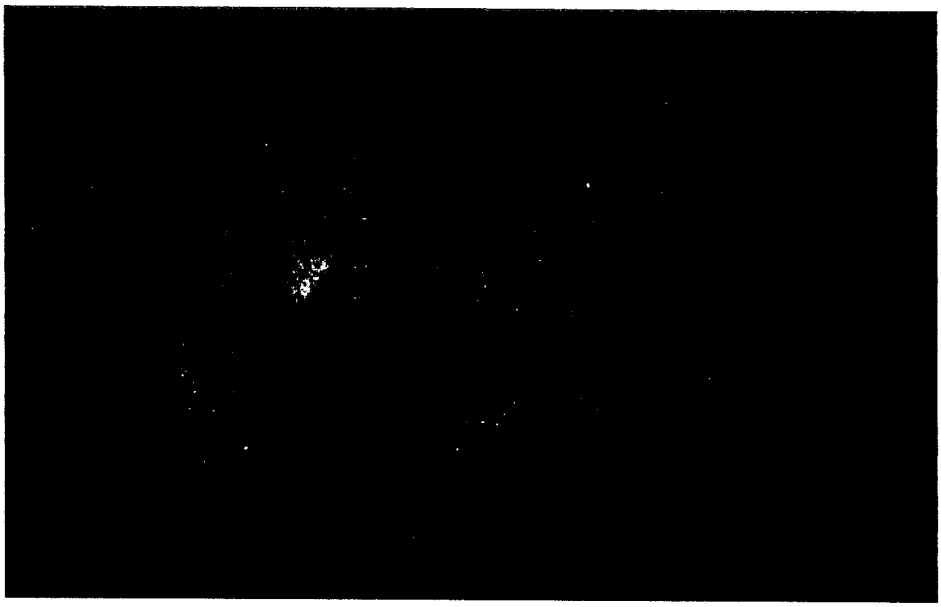
Figure 4D:
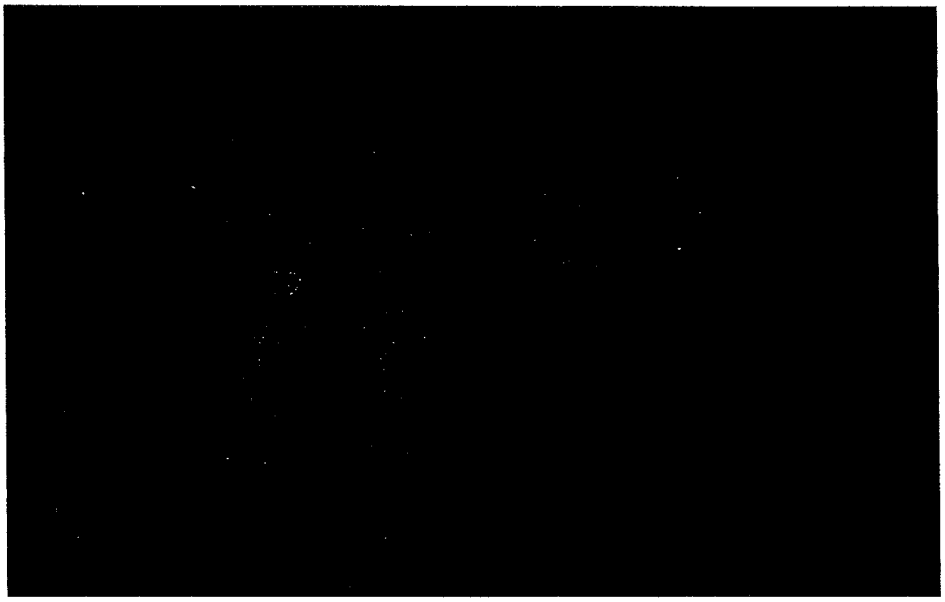

In this regard, it should be noted that although the standardized photographs of FIGS. 4–4D were made with products exhibiting a different pouch configuration and comprised of different materials of construction than the exemplary products described herein, it is the intensity of the contrast between the detergent "footprint" and the black swatch and not the size of the "footprint" which is assigned an ordinal grade. A grade of "1", which corresponds to the photo of FIG. 4 represents the worst case, while a grade of "9", which corresponds to the photo of FIG. 4D, represents the best possible case (no noticeable dust). Intermediate grades in order to increasing severity are: "7" (corresponding to FIG. 4C); "5" (corresponding to FIG. 4B); and "3" (corresponding to FIG. 4A).

The average drop testing grade for at least 4 samples of each exemplary product tested were as follows:

| Product Type | Average Ordinal Grade |
|---|---|
| Product identical to Example I embodiments, but not including any softener/anti-stat particulate | 9 (corresponding to FIG. 4D) |
| Product identical to Example IV embodiments, but not including any softener/anti-stat particulate | 9 (corresponding to FIG. 4D) |

From the foregoing drop testing, it can be seen that the microapertured polymeric film pouches performed about as well as the nonwoven pouches for purposes of retaining the dry detergent particulate when the individual products are subjected to impact loading prior to use by the end user.

B. WASHER PERFORMANCE

The cleaning ability of through the washer and dryer laundry additive products is considered to be strongly correlated with both how fast and how completely the detergent is dissolved and dispersed into the wash water.

CONDUCTIVITY TEST

This test measures the dissolving rate of the detergent particulate 40 by tracking the bulk mixing conductivity of the wash water. The assumption is that the rate of diffusion/convection of ionic species in the detergent is representative of the detergent as a whole. To minimize the chance that the softener/anti-stat particulate could contaminate the conductivity test data, the softener/anti-stat particulate was not included in the products subjected to the wash water conductivity test.

Products in all other respects identical to each of Examples I through IV were filled with 55 grams of detergent and stapled within an "envelope" formed from a 12 inch by 12 inch, 40 gram terry cloth towel which was folded in half. This was intended to mimic a worst-case situation where the product is trapped inside an article of clothing.

This "envelope" containing one of the exemplary test products was placed in a Kenmore Model No. 82470120 automatic washer, as available from Sears & Roebuck of Chicago, Ill. The washer was filled with 17 gallons of 45° F. (7.2° C.) city water (cold water is another worst case scenario), and agitated for 10 minutes with the machine set at the "cotton/sturdy" cycle. Approximately one cup of water was sampled every 30 seconds, its conductivity was measured and it was then returned to the washer.

Normally the conductivity reading reaches a plateau at some maximum conductivity value. The time when this occurs is noted. The time for 95% completion of dissolution is interpolated from the data thus collected and the average time in seconds for 95% completion of dissolution for at least four such tests on each exemplary product type is reported below:

| Product Type | Time (Seconds) |
|---|---|
| Product identical to Example I embodiments, but not including any softener/anti-stat particulate | 175 |
| Product identical to Example II embodiments, but not including any softener/anti-stat particulate | 293 |
| Product identical to Example III embodiments, but not including any softener/anti-stat particulate | 212 |
| Product identical to Example IV embodiments, but not including any softener/anti-stat particulate | 243 |

From the foregoing conductivity testing, it is clear that although all of the exemplary product types will plateau, the pouches employing a pair of microapertured polymeric film sidewalls with outwardly oriented microapertured protuberances (similar to Example I) required the least amount of time for the conductivity of the wash water to plateau.

Orienting the microapertured film so that both of the pouch sidewalls exhibited microapertured protuberances which were inwardly directed toward the interior of the pouch (similar to Example III) increased the time required for the conductivity to plateau only slightly. However, replacing one of the microapertured polymeric film sidewalls with a layer of moisture-impermeable polymeric film (similar to Example II) considerably increased the time required for the wash water conductivity to plateau.

Interestingly, the pouch employing a pair of porous nonwoven sidewalls (similar to Example IV) required longer than either of the pouches employing a pair of microapertured sidewalls, regardless of which way the microapertured protuberances in the sidewalls were oriented.

SOLUBILITY TEST MEASURING RESIDUAL DETERGENT IN POUCH

This test measures the degree of completeness of detergent dissolution under worst scenario conditions using a clothing load.

To minimize the chance that the softener/anti-stat particulate could introduce any extraneous effects into the data collected during the solubility test, the exemplary products subjected to this particular test did not include any of the softener/anti-stat particulate in compartments 30. Exemplary products in all other respects identical to each of Examples I through IV were constructed. Each dual compartment product was filled with a total of 55 grams of detergent particulate 40.

Four products of each exemplary type were individually weighed and then all four products were placed into a Kenmore Model No. 82470120 automatic washer, as available from Sears & Roebuck of Chicago, Ill. The washer was filled with 20 gallons of 45° F. (7.2° C.) city water (again assuming a worst case scenario) along with a clothing load having a total weight of approximately 9.25 pounds and comprised of the following items: 4 dress shirts; 1 two-piece sweat suit; 4 women's two-piece pajamas; 4 women's slips; 4 sweaters; and 2 bathrobes.

The four test products and the clothing load were agitated for 8 minutes on the "cotton/sturdy" setting. Before the rinse, the four products being tested were removed from the washer and air dried. Each product was again weighed. The difference between the initial weight and the final weight of each test product was recorded. The test procedure was repeated a total of five times for each example product type to provide a total of 20 data points for each exemplary product type. The average value of these data points for each exemplary product type is hereinafter reported both in terms of grams of detergent remaining and in terms of percent residual detergent, i.e., (grams of detergent remaining in pouch after test) divided by (grams of detergent initially contained in pouch) multiplied by 100.

| Product Type | Grams of Detergent Remaining in Pouch | Percent Residual Detergent |
|---|---|---|
| Product similar to Example I embodiments, but not including any softener/anti-stat particulate | 2.9 | 5.3 |
| Product similar to Example II embodiments, but not including any softener/anti-stat particulate | 4.4 | 8.0 |
| Product similar to Example III embodiments, but not including any softener/anti-stat particulate | 5.8 | 10.5 |
| Product similar to Example IV embodiments, but not including any softener/anti-stat particulate | 2.1 | 4.0 |

None of the exemplary test products appear to retain such a high level of residual detergent as to be unacceptable for use. However, it is interesting to note that the exemplary product employing a pair of microapertured polymeric film sidewalls having their microapertured protuberances outwardly oriented from the interior of the pouch (similar to Example I) exhibited nearly the same total delivery of detergent, i.e., 52.1 grams out of 55 grams, as an identically constructed product employing a pair of porous nonwoven sidewalls (similar to Example IV), i.e., 52.9 grams out of 55 grams.

When taken in conjunction with the conductivity test data, one conclusion supported by these data is that particularly preferred products of the present invention, i.e., products employing a pair of polymeric sidewalls having outwardly oriented microapertured protuberances, are capable of delivering substantially the same total quantity of detergent to the wash water, but doing so more quickly than pouches employing a pair of porous nonwoven sidewalls. It follows that since this quantity of detergent may act upon the textiles being laundered for a longer period of time, this should improve the effectiveness of cleaning during the wash cycle.

C. DRYER PERFORMANCE

Static control and softening are the two major dryer benefits which are desired in through the washer and dryer laundry additive products. However, staining of clothing is the accompanying major negative which normally increases in severity as softening and static control imparted by the dryer additive are improved upon. The softening and static control benefits imparted to textile articles are strongly correlated to the amount of softener/anti-stat delivered. However, based on the present learnings, staining has been found to be more strongly correlated to a lack of uniformity of distribution of the dryer added softener/anti-stat onto the textile articles rather than to the total quantity of softener/anti-stat applied.

QUANTITATIVE MEASUREMENT OF SOFTENER/ANTI-STAT RELEASE AND ACCOMPANYING EVALUATION OF STAINING OF TEXTILE ARTICLES

Because the quantity of softener normally employed in pouched through the washer and dryer laundry additive products is small relative to the quantity of detergent employed (2–4 grams of softener/anti-stat vs. 55 grams of detergent), any residual detergent present in the pouches after a normal wash cycle would substantially drown out any quantitative softener/anti-stat dryer release data obtained from measurements taken on products initially containing both a washer additive and a dryer additive. Accordingly, this particular test is run on the subcombination comprising a dryer additive product without detergent. It is also run without subjecting the test product to a wash cycle.

While no wash cycle was employed in this particular test, it is of course recognized that the exemplary subcombination products are capable of surviving a complete wash cycle without negatively impacting upon their subsequent dryer performance. Accordingly, the end user has the option of inserting these subcombination products, either alone or in combination a washer additive, into the automatic washer along with the textile articles to be laundered. Alternatively, they may be inserted directly into the automatic dryer after the washing cycle has been completed. In either case, the improved delivery efficiency and more uniform distribution of dryer additive is realized when these products are constructed in accordance with the present invention.

Exemplary product embodiments constructed in a manner identical to each of Examples I through IV, but containing 2 grams of softener/anti-stat particulate 50 and no detergent particulate 40 were constructed. Each exemplary product embodiment was first weighed and then hand-wetted. It was thereafter placed in a Kenmore heavy duty dryer, Model No. 86471810, as available from Sears & Roebuck of Chicago, Ill., along with a load of clothes. The load of clothes comprised a multiplicity of discrete articles hereinafter referred to as a "standard dryer bundle" and a set of 9 "standard staining swatches", each measuring about 15 inches by about 30 inches. The "standard dryer bundle" had a dry weight of approximately 5.1 pounds. The "standard dryer bundle" and the "standard staining swatches" are hereinafter described in greater detail:

| Standard Dryer Bundle | | | |
|---|---|---|---|
| Item | Count | Fabric | Weight per count (grams) |
| Large bath towel | 1 | Cotton | 250 |
| Small bath towel | 2 | Cotton | 144 |
| T shirt | 2 | Cotton | 136 |
| T shirt | 1 | 50/50 polyester/cotton | 136 |
| Pillow case | 2 | 65/35 polyester/cotton | 106 |
| Shirt | 1 | 65/35 polyester/cotton | 141 |
| Denim jeans | 1 | 50/50 polyester/cotton | 454 |
| Slip | 1 | Nylon | 91 |
| Blouse | 1 | Polyester | 151 |
| Slacks | 1 | Polyester | 212 |
| Pair of socks | 1 | Nylon | 45 |

-continued

| Pair of socks | 1 | Polyester | 45 |
|---|---|---|---|

Standard Staining Swatches

| Color | Fabric | Weave or Other Designation |
|---|---|---|
| Emerald Blue | Polyester | etched oriental |
| Red | Nylon | rip-stop |
| Blue | 65/35 polyester/cotton | tight square |
| Gold | 65/35 polyester/cotton | loose square |
| Tan | Polyester | Saraline |
| Rose | 50/50 polyester/cotton | broadcloth |
| Blueberry | 85/15 cotton/polyester | corduroy |
| Charcoal Grey | Polyester | etched USA |
| Pale Blue | Nylon | Quiana |

Figure 5:
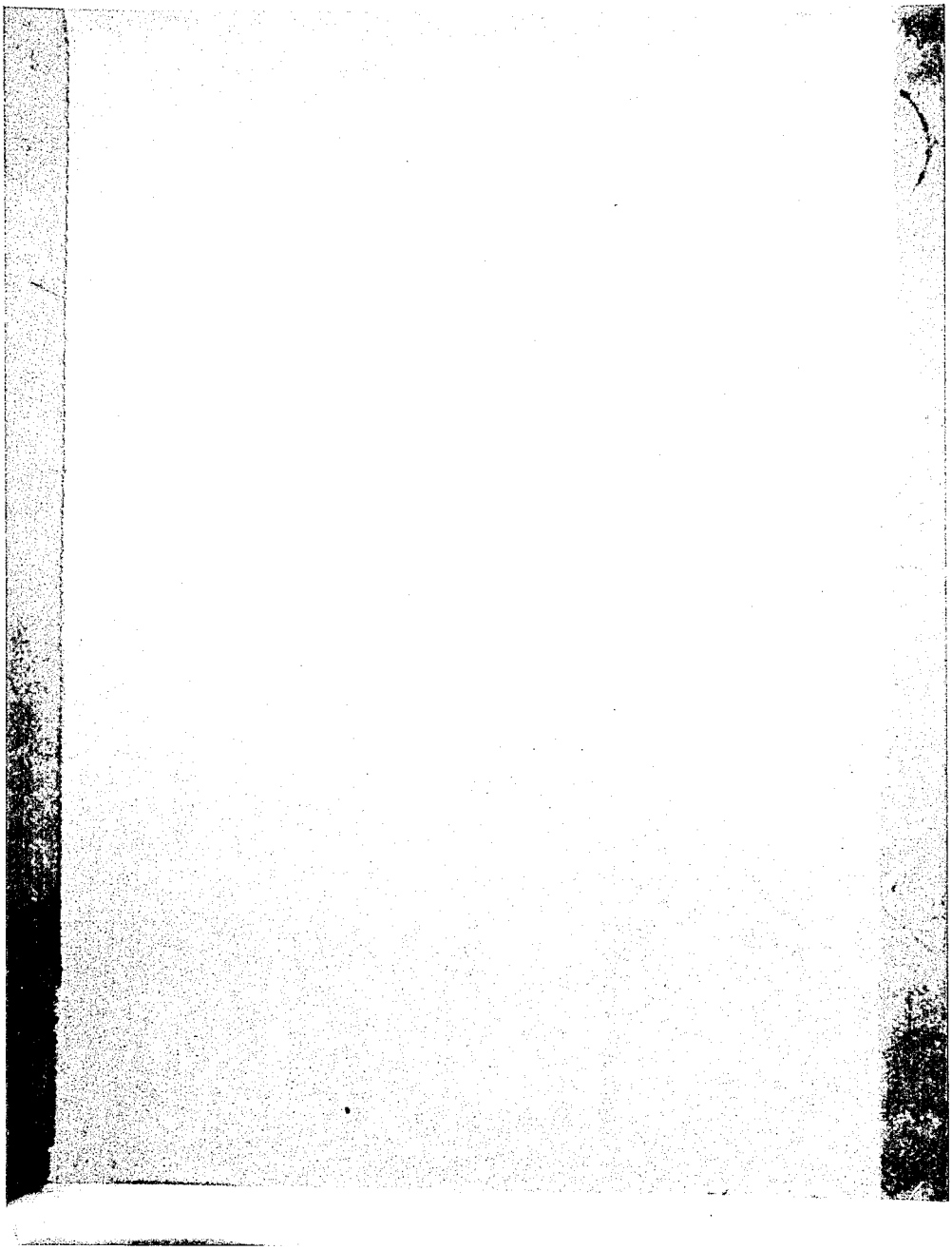
FIGS. 5, 5A and 5D are representative photographs of fabric swatches used as a calibration to grade the tendency of the laundry additive products tested to stain the textiles being treated during the tumble drying cycle.

Prior to initiating the drying cycle, the aforementioned "standard dryer bundle" and "standard staining swatches" were rinsed in a Kenmore heavy duty washer, Model No. 82470120, as available from Sears & Roebuck of Chicago, Ill., with 60° F. (16° C.) city water and subjected to a spin drying cycle to more accurately simulate the moist condition of freshly laundered textiles.

considered during this particular evaluation. Intermediate stain grades are likewise possible, for example, FIG. 5D is representative of a stain grade of "2". For purposes of this evaluation, swatches receiving a stain grade of "1" or "2" are classified as "non-seriously stained". Conversely swatches receiving a stain grade of "3", "4" or "5" are classified as "seriously stained".

Figure 5A:
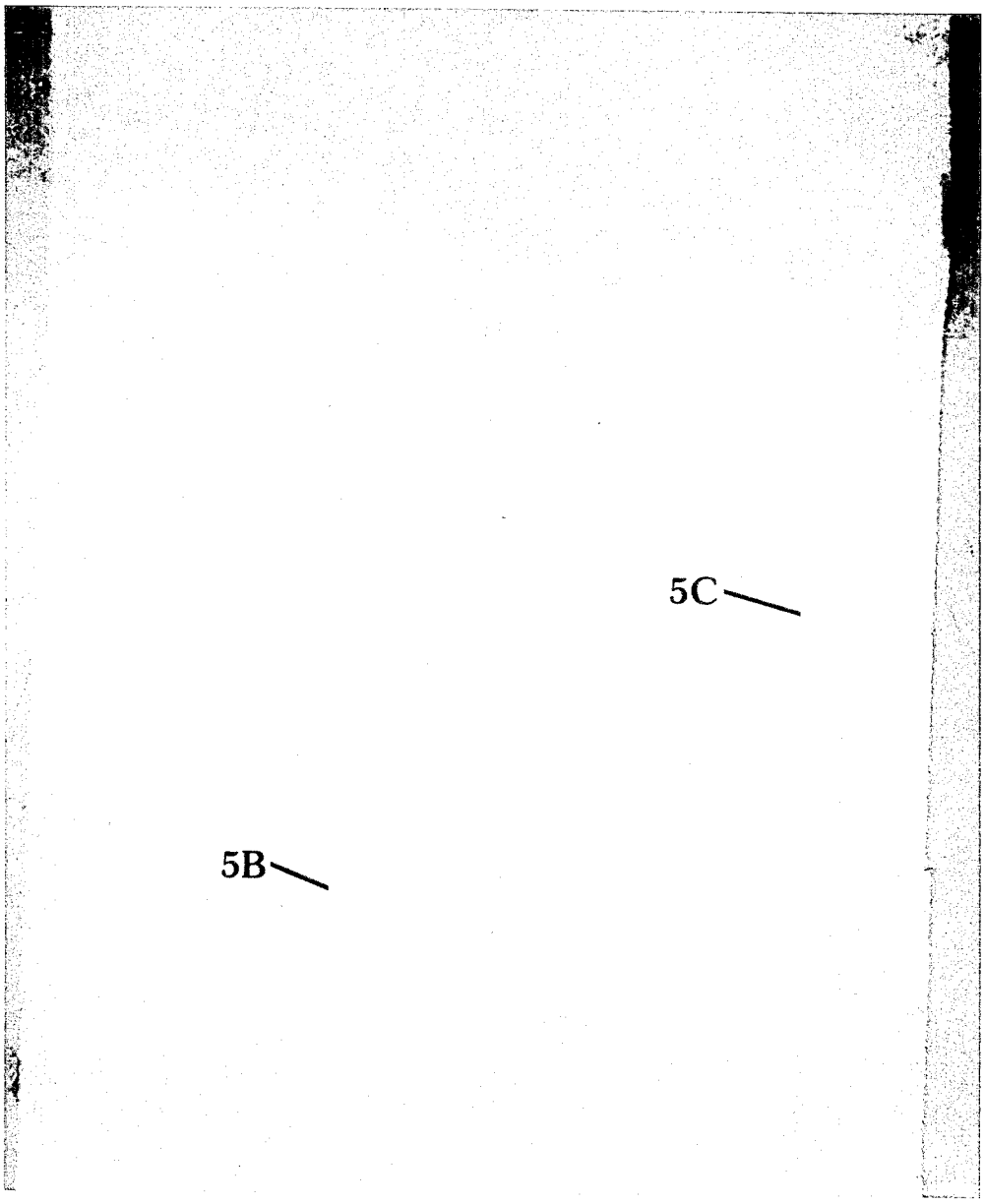
Figure 5B:
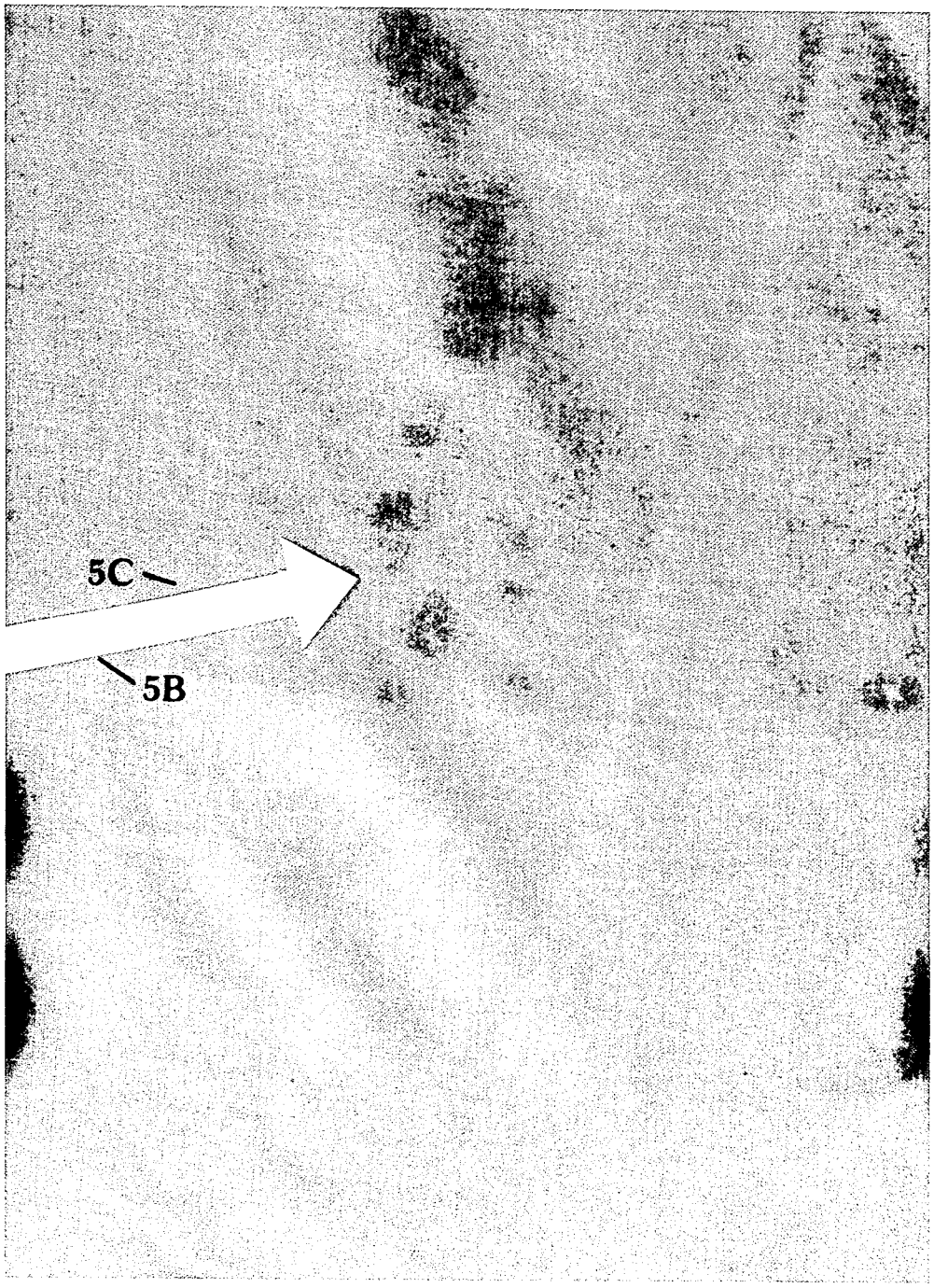
FIGS. 5B and 5C are greatly enlarged portions of the photograph of FIG. 5A showing the stains identified by arrows 5B and 5C, respectively, in FIG. 5A.
Figure 5C:
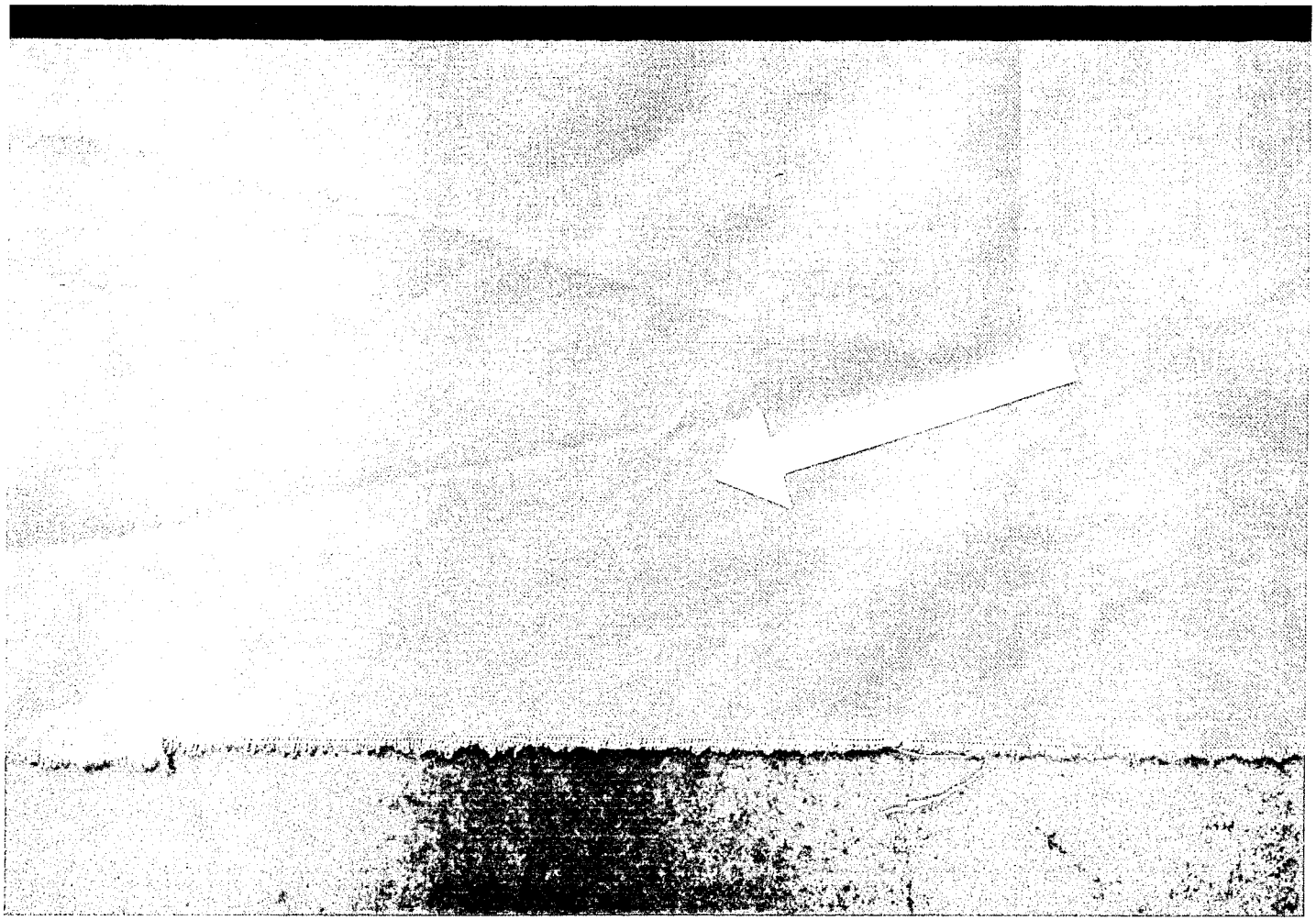
Figure 5D:
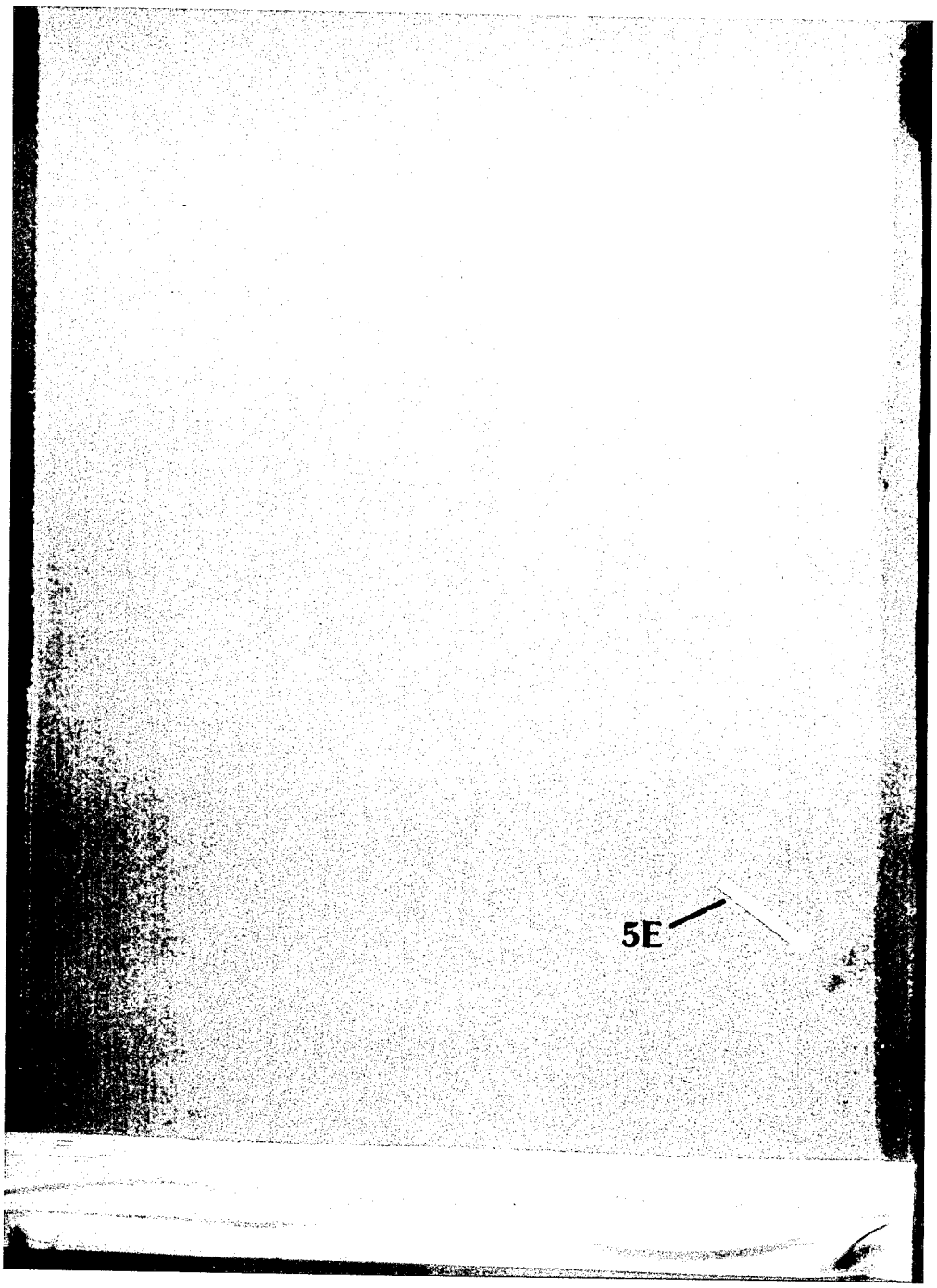
Figure 5E:
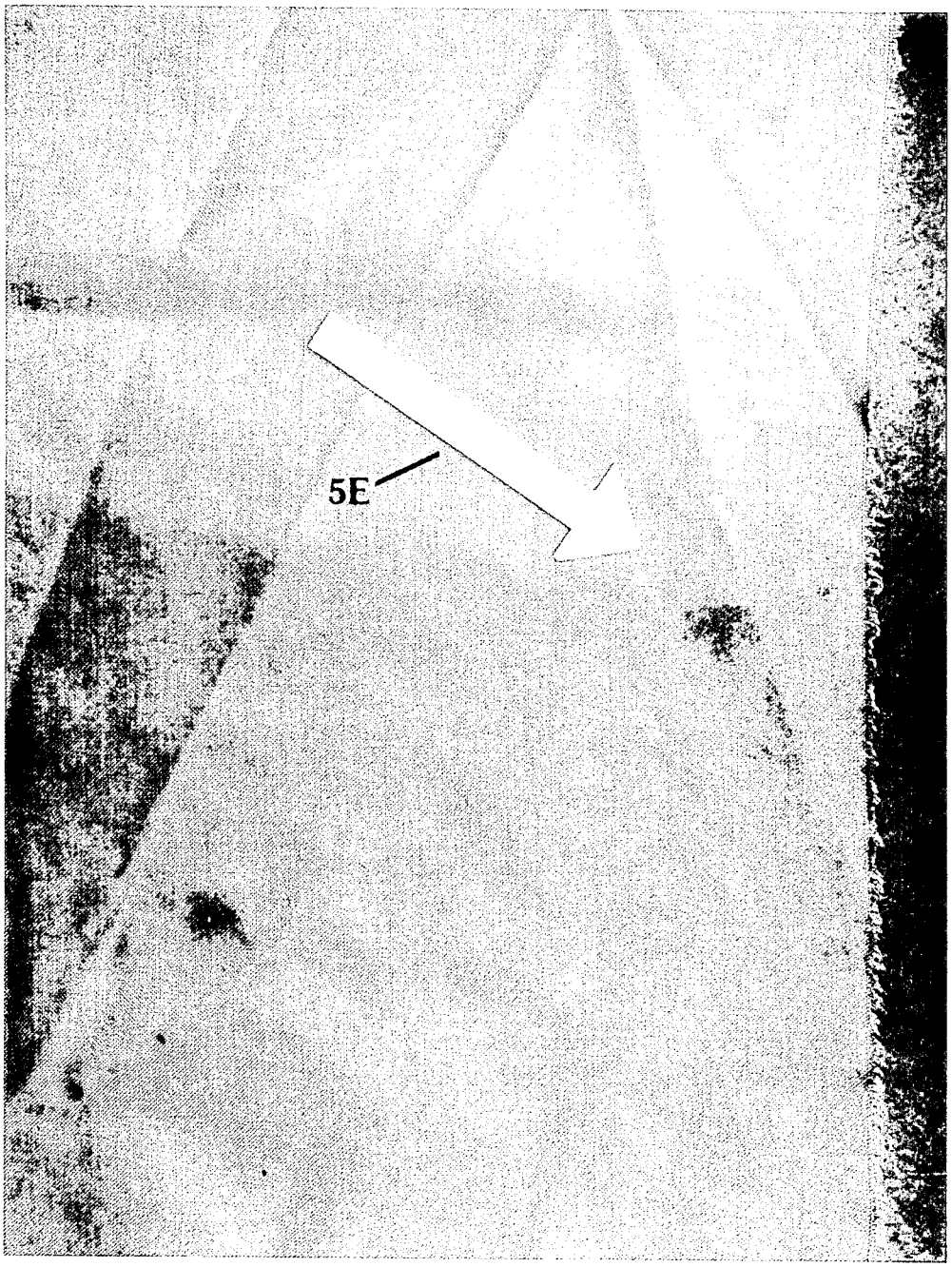
FIG. 5E is a greatly enlarged portion of the photograph of FIG. 5D showing the stain identified by arrow 5E in FIG. 5D.

FIGS. 5B and 5C are greatly enlarged portions of the photograph of FIG. 5A showing the stains identified by arrows 5B and 5C, respectively, in FIG. 5A. Note that some of the solid softener/anti-stat is actually visible on the surface of the swatch in the enlarged photograph of FIG. 5C. Similarly, FIG. 5E is a greatly enlarged portion of the photograph of FIG. 5D showing the stain identified by arrow 5E in FIG. 5D.

Since the staining problem is a function of both the number of spots and their size, the total number of swatches stained, i.e., receiving a stain grade of "1", "2", "3", "4" or "5", and the number of swatches classified as "seriously stained", i.e., receiving a stain grade of "3", "4" or "5", are both set forth in Table I. These grades are also the average of at least six such dryer tests on each exemplary product type.

TABLE I

| Product Type | Grams of softener/ anti-stat initially present | Grams of softener/ anti-stat delivered | Delivery efficiency (Grams of softener/ anti-stat delivered) / (Grams of softener/ anti-stat initially present) × 100 | Total Number of swatches stained (i.e., the number of swatches having an ordinal stain grade of "1", "2", "3", "4" or "5" | Number of swatches seriously stained (i.e., the number of swatches having an ordinal stain grade of "3", "4" or "5" |
|---|---|---|---|---|---|
| Product identical to Example I embodiments, but not includ. any deterg. particulate | 2.0 | 1.39 | 69.5 | 7 | 5 |
| Product identical to Example II embodiments, but not includ. any deterg. particulate | 2.0 | 1.31 | 65.5 | 7 | 5 |
| Product identical to Example III embodiments, but not includ. any deterg. particulate | 2.0 | 1.29 | 64.5 | 7 | 5 |
| Product identical to Example IV embodiments, but containing only 2 gr, of softener/anti-stat particulate and not includ. any detergent particulate | 2.0 | 0.49 | 24.5 | 8 | 4 |

The Kenmore dryer was thereafter operated for 50 minutes on the "cotton/sturdy" setting. The exemplary product embodiment being evaluated and the staining swatches were removed. The exemplary product embodiment being evaluated was then reweighed and the reduction in weight was assumed to be due to the loss of the fabric softener/anti-stat delivered onto the textile articles. The average result in terms of grams of softener/anti-stat delivered and delivery efficiency in percent, i.e., (grams of softener/anti-stat delivered) divided by (grams of softener/anti-stat initially present) multiplied by 100, for at least six such dryer tests on each exemplary product type is reported along with the corresponding average stain grade in Table I.

The "standard staining swatches", which were also removed from the dryer along with the spent pouches, were graded by a trained grader according to a "0" to "5" ordinal scale using a standardized series of stained swatches. A stain grade of "0" (corresponding generally to the photograph of FIG. 5) signified the best possible grade amounting to no stains, while a stain grade of "5" (corresponding generally to the photograph of FIG. 5A) signified the worst possible staining From the foregoing delivery and staining data, it is clear that the delivery efficiency of all three exemplary products employing pouches comprised of polymeric film (similar to Examples I, II and III) was over twice that of the exemplary product employing a pouch comprised entirely of porous nonwoven material (similar to Example IV, but containing only 2 grams of softener/anti-stat particulate to permit uniform comparisons). However, perhaps even more surprising was the fact that for the relatively smaller quantity of softener/anti-stat delivered onto the textile articles by the exemplary products employing pouches comprised entirely of porous nonwoven material (similar to Example IV, but containing only 2 grams of softener/anti-stat particulate to permit uniform comparisons), the total number of swatches stained was slightly greater than for any of the pouches comprised of polymeric film. Furthermore, the number of swatches seriously stained was nearly as great for the pouches comprised entirely of nonwoven material as for any of the pouches comprised of polymeric film.

To confirm the accuracy of the foregoing findings, the tests were repeated on another exemplary product identical to Example IV, but not including any detergent particulate 40. This exemplary product was filled with 4 grams of softener/anti-stat particulate 50 (the same amount of softener/anti-stat particulate used in the Example IV product embodiments to impart a measurable degree of softening and static control to the treated textiles) rather than the 2 grams tested earlier. The average result for at least six such dryer tests on the nonwoven product containing twice as much softener-/anti-stat particulate product are set forth in Table II.

TABLE II

| Product Type | Grams of softener/ anti-stat initially present | Grams of softener/ anti-stat delivered | Delivery efficiency (Grams of softener/ anti-stat delivered) / (Grams of softener initally present) × 100 | Total Number of swatches stained (i.e., the number of swatches having an ordinal stain grade of "1", "2", "3", "4" or "5" | Number of swatches seriously stained (i.e., the number of swatches having an ordinal stain grade of "3", "4" or "5" |
|---|---|---|---|---|---|
| Product identical to Example IV embodiments, including 4 grams of softener/anti-stat particulate, but no detergent particulate | 4.0 | 1.18 | 30 | 8 | 6 |

Even when twice as much starting softener/anti-stat particulate 50 was employed in the compartments 30 of the pouch, (4 grams versus 2 grams), the exemplary product employing a pouch comprised entirely of porous nonwoven material exhibited a delivery efficiency less than half that of any of the exemplary products employing pouch walls comprised of polymeric film and initially containing only half as much softener/anti-stat. Accordingly, the total amount of softener/anti-stat actually delivered onto the textile articles by the modified exemplary product was also somewhat less than for any of the exemplary products employing pouches comprised of polymeric film. Perhaps most importantly, however, staining of the textile articles, both in terms of total number of swatches stained and number of swatches seriously stained, was greater for this nonwoven product than for any of the polymeric film products, despite the fact that the total quantity of softener-/anti-stat actually delivered onto the textile articles was somewhat less.

All of the foregoing test data support the conclusion that increasing the uniformity of distribution via the metering-like action of the finely apertured polymeric film provides a substantial increase in the total amount of softener/anti-stat applied to the textile articles during the tumble drying cycle without increasing the tendency to stain the textile articles. Similar trends have been observed when products of the present invention are compared to comparably constructed products having pouches comprised entirely of porous paper.

STATIC CONTROL AND ASSOCIATED SOFTENER/ANTI-STAT STAINING USING COMPLETE THROUGH THE WASHER AND DRYER PRODUCTS

As will be appreciated by those skilled in the art, the tests described in the preceding paragraphs were conducted utilizing modified and, in some instances, subcombination products to measure the effect of one or more variables at particular points prior to and during the washing and/or drying cycles. The present paired comparison test, unlike the preceding tests, utilized complete through the washer and dryer laundry products in a conventional washing and drying cycle in a manner which would approximate a consumer's use of these products in a real life situation.

Products identical to those of Example I and those of Example IV were utilized in the two legs of this comparison test. Each exemplary product contained a total of 55 grams of detergent particulate 40. The Example I product embodiments contained a total of 2 grams of softener/anti-stat particulate 50, while the Example IV product embodiments contained a total of 4 grams of softener/anti-stat particulate 50. The additional 2 grams of softener/anti-stat particulate in the Example IV product embodiments was believed necessary to impart a noticeable degree of softening and static control to the textiles being laundered and dried.

A "standard dryer bundle", as described earlier herein, a set of "standard staining swatches", also as described earlier herein, and one exemplary product were run through the "14 minute cotton/sturdy" cycle using 60° F. (16° C.) water on a Kenmore automatic washer, Model No. 82470120, as available from Sears & Roebuck of Chicago, Ill.

After the washer spin cycle, the entire washer contents, including the exemplary product being tested, were transferred to a Kenmore heavy duty dryer, Model No. 86471810, as available from Sears & Roebuck of Chicago, Ill. The dryer was located in a controlled temperature and humidity room maintained at 72° F. (22° C.) and 7% relative humidity (to simulate a worst case scenario). The dryer contents were subjected to 45 minutes of drying on the "cotton/sturdy" cycle, followed by 5 minutes of tumbling in unheated air (the cool down).

The entire dryer contents were then placed in a Faraday cage also located within the controlled temperature and humidity room, and each article was removed from the Faraday cage one-by-one. During removal, voltage was measured off the Faraday cage each time an article was removed and summed for the load. Clinging of each article removed to those articles remaining in the cage was also noted and summed.

Stain grading identical to that employed in the preceding dryer test was utilized to grade the standard staining swatches.

The average result of this through the washer and dryer laundry additive product comparison, based on at least 4 such tests for each exemplary product type, is set forth in Table III.

TABLE III

| Product Type | Grams of softener/ anti-stat initially present | Static charge in volts (as measured in Faraday cage) | Total number of swatches stained (i.e., the number of swatches having an ordinal stain grade of "1", "2" "3", "4" or "5" | Number of swatches severely stained (i.e., the number of swatches having an ordinal stain grade of "3", "4" or "5" | Number of clings, i.e., one or more articles clinging to the article being removed from the Faraday cage |
|---|---|---|---|---|---|
| Products identical to Example I embodiments | 2.0 | 16 | 5 | 1 | 0 |
| Products identical to Example IV embodiments | 4.0 | 30 | 6 | 2 | 0 |

From the foregoing comparison of the products of Example I with the products of Example IV, which initially contained approximately twice as much of the softener/anti-stat particulate 50, it is clear that the static charge remaining on the textile load treated with the microapertured polymeric film pouch (Example I), is only about 50% of that remaining on an identical textile load treated utilizing a pouch comprised entirely of porous nonwoven material (Example IV). While not wishing to be bound, it is believed that the lower static charge exhibited by the textile articles treated with the finely apertured polymeric film pouch is due not so much to the total quantity of softener/anti-stat delivered, but rather to the more uniform distribution of the softener/anti-stat onto the textile articles. (Recall from the earlier dryer test work that the total quantity of softener/anti-stat delivered was roughly the same for the apertured film pouch and the nonwoven pouch when the latter products contained approximately twice as much of the starting softener/anti-stat material.)

It should also be noted from the staining data set forth in the paired comparison of Table III that the microapertured polymeric film pouch exhibited a slightly lower staining tendency than the porous nonwoven pouch. This too is consistent with the previous dryer test results.

ALTERNATIVE EMBODIMENTS OF THE PRESENT INVENTION

Figure 3:
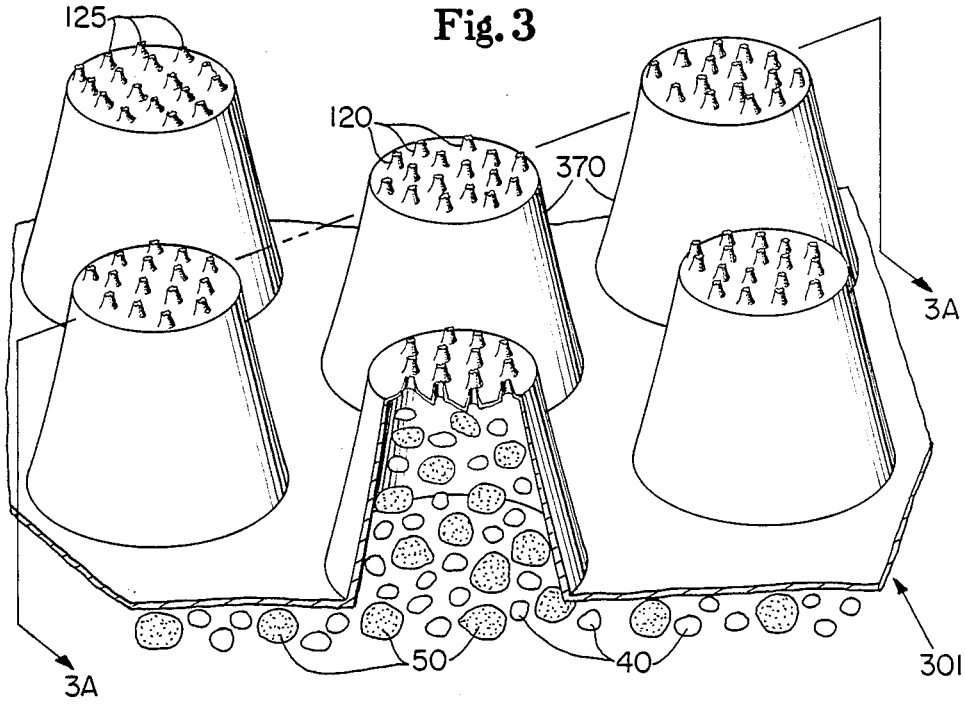
FIG. 3 is a greatly enlarged, simplified, partially segmented perspective view of a macroscopically expanded polymeric film having a pattern of macroscopic cross-section debossments with finely apertured end walls, said film being particularly preferred for use in constructing one or both walls of a pouched through the washer and dryer laundry additive product of the present invention, said view being taken at a point corresponding to inset 2 in FIG. 1.
Figure 3A:
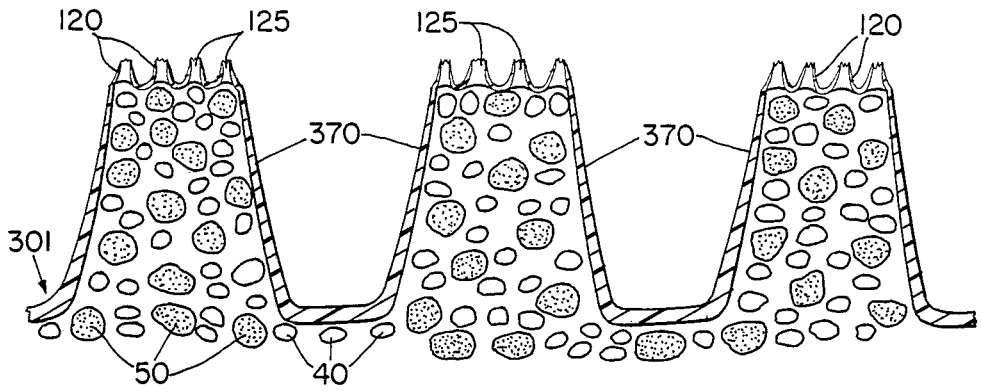
FIG. 3A is a simplified partial cross-sectional view of the product shown in FIG. 3, said cross-section being taken at a point corresponding to section line 3A—3A in FIG. 3.

FIG. 3 discloses an alternative embodiment of a finely apertured polymeric film 301 which may be employed as an uppermost layer 10, a lowermost layer 20 or both in a through the washer and dryer laundry additive product of the present invention.

The macroscopically expanded polymeric web 301 shown in FIG. 3 may, if desired, be produced utilizing a compound forming structure of the type generally disclosed in FIGS. 10A and 10B of commonly assigned U.S. Pat. No. 4,609,518 issued to Curro et al., said patent being incorporated herein by reference. The web of film may be caused to conform to the macroscopic cross-section of the forming structure using a fluid pressure differential such as vacuum to form a multiplicity of macroscopic cross-section debossments 370. The macroscopically expanded web may thereafter be subjected to a high pressure fluid jetting operation while still supported on the compound forming structure to provide a regularly repeating pattern of protuberances 120, each containing a microaperture 125 at its tip, in the end walls of the macroscopic cross-section debossments. The latter microapertured protuberances 120 can be essentially the same as the microapertured protuberances 120 employed on non-macroscopically expanded polymeric web 101 shown in FIG. 2.

Alternatively, the web of film may be supported on a forming structure of the type illustrated in FIGS. 10A and 10B of the aforementioned commonly assigned U.S. Pat. No. 4,609,518, and the macroscopic expansion and microaperturing operations performed in a single pass under a high pressure fluid jet of the type generally disclosed in commonly assigned U.S. Pat. No. 4,695,422, said patent also being incorporated herein by reference.

The macroscopic cross-section debossments preferably impart an overall caliper of at least about 30 mils (0.030 inches) to the web, most preferably at least about 40 mils (0.040 inches), as measured under a no load condition. The particular pattern and configuration of the macroscopic cross-section debossments is normally chosen so as to optimize both the visual and tactile impression of the exposed surface of the resultant web of film 301.

When macroscopically expanded polymeric webs of the type shown in FIG. 3 are employed to fabricate pouches of the present invention, they are preferably oriented so that the macroscopic cross-section debossments 370 and the microapertured protuberances 120 in the end walls of the debossment are both outwardly oriented from the interior of the pouch, as generally shown in FIG. 3. This presents the most aesthetically and tactually pleasing surface to the end user. In addition, this orientation promotes contact between the microapertured protuberances 120 and the textile articles to be treated during the tumble drying cycle.

Through the washer and dryer laundry additive products of the present invention having pouch walls comprised entirely of macroscopically expanded, microapertured film similar to that shown in FIG. 3 have demonstrated an ability to provide softener delivery efficiencies which are intermediate those of pouches constructed entirely of porous nonwoven material and those constructed entirely of non-macroscopically expanded microapertured webs of the type shown in FIG. 2. However, such macroscopically expanded, microapertured webs have reduced the textile staining tendency of the softener/anti-stat material delivered during the tumble drying cycle to a level which is even lower than for non-macroscopically expanded microapertured polymeric webs of the type generally shown in FIG. 2. While not wishing to be bound, it is believed that the additional stiffness and caliper imparted to the pouch walls by the macroscopic cross-section debossments 370 tends to reduce the severity of the impacts to which the softener/anti-stat material is subjected during collisions which occur between the pouch and the textile articles during the tumble drying cycle.

It is further believed that this improves the uniformity of distribution of softener/anti-stat through the microapertured end walls of the debossments.

While best results in practicing the present invention are generally obtained when the entire pouch is constructed of substantially nonabsorbent polymeric film, it has been observed that some of the benefits described herein are still obtainable when only uppermost layer 10 or lowermost layer 20 are comprised of microapertured polymeric film, the other layer of the pouch being comprised of a more conventional porous nonwoven, paper or other absorbent material.

From the data collected in the series of tests described herein, it is believed that the superior dryer additive delivery efficiency of pouched through the washer and dryer laundry additive products of the present invention relative to similarly constructed pouches comprised entirely of porous nonwoven material has been clearly demonstrated. The unexpected benefit accompanying this discovery is that the total quantity of dryer additive which can be delivered onto the textile articles being tumble dried can be increased significantly without any significant increase in textile staining. Thus the present invention makes it possible for the end user to obtain laundered and dried textile articles which are softer and which exhibit less static cling without increased staining. These benefits have not previously been obtainable using pouches comprised entirely of porous nonwoven and/or paper material.

While particular embodiments of the present invention have been illustrated and described, it will be obvious to those skilled in the art that various changes and modifications can be made without departing from the spirit and scope of the invention. For example, macroscopically expanded polymeric webs employed in pouched through the washer and dryer laundry additive products of the present invention may include macroscopic cross-section debossments having fine scale apertures in their side walls as well as in their end walls to increase the distribution efficiency of the dryer additive. In still another embodiment of the present invention, an intermediate layer of macroscopically expanded and macroscopically apertured substantially water impermeable polymeric film could be employed between a pair of substantially planar, finely apertured polymeric film outermost walls of a pouch to impart stiffness and resistance to compression to the pouch and thereby afford many of the same benefits obtained through the use of macroscopically expanded outermost pouch walls of the type generally shown in FIG. 3. A particularly preferred material for such an intermediate layer is disclosed in FIG. 6C of commonly assigned U.S. Pat. No. 4,342,314 issued to Radel and Thompson on Aug. 3, 1982, said patent being hereby incorporated herein by reference. It is intended to cover in the appended claims all such modifications and changes that are within the scope of this invention.

What is claimed is:

1. A pouched through the washer and dryer laundry additive product for distributing a substantially predetermined quantity of washer additive into the water during the wash cycle and for applying a substantially predetermined quantity of dryer additive substantially uniformly onto the surfaces of the laundered textile articles during the tumble drying cycle, said laundry additive product comprising:

(a) a predetermined quantity of particulate water soluble washer additive;

(b) a predetermined quantity of particulate dryer additive which is substantially insoluble in water, said particulate dryer additive having a softening temperature which is greater than the temperature of the wash water, but less than the temperature normally encountered in an automatic clothes dryer; and (c) a pouch formed from at least two pliable opposing walls, said pouch including at least one discrete compartment formed by said pliable opposing pouch walls, at least one of said pliable opposing pouch walls being comprised of substantially water impermeable synthetic polymeric film which has a softening temperature greater than the maximum temperature to which it will be exposed during the washing and drying cycles, said film also being substantially nonabsorbent to said washer additive and said dryer additive, said compartment totally enclosing said particulate washer additive and said particulate dryer additive, said polymeric film pouch wall further exhibiting a pattern of protuberances which are outwardly oriented relative to the interior of said compartment, each of said protuberances exhibiting an aperture at its tip, each of said apertures being of substantially predetermined size, said pattern having a density in the range of between about 1,600 and about 14,400 apertures per square inch, substantially all of said apertures in said polymeric film pouch wall exhibiting a maximum cross-section which is small enough to prevent the bulk of said particulate washer additive and the bulk of said particulate dryer additive from passing therethrough so long as they remain in a substantially dry, solid state, said apertures in said polymeric film pouch wall also being large enough to permit said wash water to enter said pouch, dissolve said particulate washer additive and form a wash liquor which thereafter exits said pouch through said apertures during said wash cycle without dissolving said substantially water insoluble particulate dryer additive, said apertures in said polymeric film pouch wall also functioning during the tumble drying cycle to substantially uniformly distribute said dryer additive onto the surfaces of the laundered textiles which come in contact with said apertured pouch wall during the tumble drying cycle while said dryer additive is in a softened and viscous state.

2. The through the washer and dryer laundry additive product of claim 1, wherein said particulate washer additive comprises a detergent composition.

3. The through the washer and dryer laundry additive product of claim 2, wherein said particulate dryer additive comprises a softener/anti-stat composition.

4. The through the washer and dryer laundry additive product of claim 3, wherein said particulate washer additive comprising a detergent composition and said particulate dryer additive comprising a softener/anti-stat composition are substantially homogeneously mixed and contained within a common compartment.

5. The through the washer and dryer laundry additive product of claim 1, wherein said particulate washer additive is contained within a first compartment and wherein said particulate dryer additive is contained within a second compartment.

6. The through the washer and dryer laundry additive product of claim 5, including a line of weakness separating said first and second compartments along which said first and second compartments may be readily separated from one another by the end user.

7. The through the washer and dryer laundry additive product of claim 6, wherein said line of weakness comprises a line of perforations.

8. The through the washer and dryer laundry additive product of claim 1, wherein both of said pliable opposing pouch walls are comprised of polymeric film.

9. The through the washer and dryer laundry additive product of claim 4, wherein both of said pliable opposing polymeric film pouch walls exhibit said pattern of apertures.

10. The through the washer and dryer laundry additive product of claim 1, wherein said polymeric film comprises polypropylene.

11. The through the washer and dryer laundry additive product of claim 10, wherein said polypropylene film exhibits an initial thickness, prior to being apertured, of about 1 mil.

12. The through the washer and dryer laundry additive product of claim 1, wherein said polymeric film pouch wall exhibits a pattern of macroscopic cross-section debossments, at least the end walls of said debossments exhibiting said pattern of apertures of predetermined size.

13. The through the washer and dryer laundry additive product of claim 12, wherein said macroscopic cross-section debossments are oriented so that their end walls are outwardly directed from said compartment.

14. The through the washer and dryer laundry additive product of claim 1 or claim 12, wherein said pattern of apertures of substantially predetermined size exhibit a cross-sectional dimension between about 2.7 mils and about 13.8 mils in diameter.

15. The through the washer and dryer laundry additive product of claim 1, wherein the fill capacity of said compartment is not more than about 40 percent.

16. A pouched dryer laundry additive product for applying a substantially predetermined quantity of dryer additive substantially uniformly onto the surfaces of laundered textile articles during the tumble drying cycle, said dryer laundry additive product exhibiting an ability to pass through a wash cycle along with the textiles being laundered without negatively impacting upon its performance in the dryer, said laundry additive product comprising:

(a) a predetermined quantity of particulate dryer additive which is substantially insoluble in water, said particulate dryer additive having a softening temperature which is greater than the temperature of the wash water, but less than the temperature normally encountered in an automatic clothes dryer; and (b) a pouch formed from at least two pliable opposing walls, said pouch including at least one discrete compartment formed by said pliable opposing pouch walls, at least one of said pliable opposing pouch walls being comprised of substantially water impermeable synthetic polymeric film which has a softening temperature greater than the maximum temperature to which it will be exposed during the washing and drying cycles, said film also being substantially nonabsorbent to said washer additive and said dryer additive, said compartment totally enclosing said particulate washer additive and said particulate dryer additive, said polymeric film pouch wall further exhibiting a pattern of protuberances which are outwardly oriented relative to the interior of said compartment, each of said protuberances exhibiting an aperture at its tip, each of said apertures being of substantially predetermined size, said pattern having a density in the range of between about 1,600 and about 14,400 apertures per square inch, substantially all of said apertures in said polymeric film pouch wall exhibiting a maximum cross-section which is small enough to prevent the bulk of said particulate washer additive and the bulk of said particulate dryer additive from passing therethrough so long as they remain in a substantially dry, solid state, said apertures in said polymeric film pouch wall also being large enough to permit said wash water to enter said pouch, dissolve said particulate washer additive and form a wash liquor which thereafter exits said pouch through said apertures during said wash cycle without dissolving said substantially water insoluble particulate dryer additive, said apertures in said polymeric film pouch wall also functioning during the tumble drying cycle to substantially uniformly distribute said dryer additive onto the surfaces of the laundered textiles which come in contact with said apertured pouch wall during the tumble drying cycle while said dryer additive is in a softened and viscous state.

17. The pouched dryer laundry additive product of claim 16, wherein said particulate dryer additive comprises a softener/anti-stat composition.

18. The pouched dryer laundry additive product of claim 17, wherein both of said pliable opposing pouch walls are comprised of polymeric film.

19. The pouched dryer laundry additive product of claim 16, wherein said polymeric film comprises polypropylene.

20. The pouched dryer laundry additive product of claim 19, wherein said polypropylene film exhibits an initial thickness, prior to being apertured, of about 1 mil.

21. The pouched dryer laundry additive product of claim 16, wherein both of said pliable opposing polymeric film pouch walls exhibit said pattern of apertures.

22. The pouched dryer laundry additive product of claim 16, wherein said polymeric film pouch wall exhibits a pattern of macroscopic cross-section debossments, at least the end walls of said debossments exhibiting said pattern of apertures of predetermined size.

23. The pouched dryer laundry additive product of claim 22, wherein said macroscopic cross-section debossments are oriented so that their end walls are outwardly directed from said compartment.

24. The pouched dryer laundry additive product of claim 16, wherein the bulk of said softener/anti-stat particles exhibit a size and shape which will permit them to pass through a number 12 U.S. standard screen yet be retained on a number 30 U.S. standard screen, and wherein said pattern of apertures of predetermined size exhibit a cross-sectional dimension between about 2.7 mils and about 13.8 mils in diameter.

25. A pouched through the washer and dryer laundry additive product for distributing a substantially predetermined quantity of washer additive into the water during the wash cycle and for applying a substantially predetermined quantity of dryer additive substantially uniformly onto the surfaces of the laundered textile articles during the tumble drying cycle, said laundry additive product comprising:

(a) a predetermined quantity of particulate water soluble washer additive;

(b) a predetermined quantity of particulate dryer additive which is substantially insoluble in water, said particulate dryer additive having a softening temperature which is greater than the temperature of the wash water, but less than the temperature normally encountered in an automatic clothes dryer; and (c) a pouch formed from at least two pliable opposing walls, said pouch including at least one discrete compartment formed by said pliable opposing pouch walls, each of said pliable opposing pouch walls being comprised of substantially water impermeable synthetic polymeric film which has a softening temperature greater than the maximum temperature to which it will be exposed during the washing and drying cycles, said film also being substantially nonabsorbent to said washer additive and said dryer additive, said compartment totally enclosing said particulate washer additive and said particulate dryer additive, said polymeric film pouch wall further exhibiting a pattern of protuberances which are outwardly oriented relative to the interior of said compartment, each of said protuberances exhibiting an aperture at its tip, each of said apertures being of substantially predetermined size, said pattern having a density in the range of between about 1,600 and about 14,400 apertures per square inch, substantially all of said apertures in said polymeric film pouch wall exhibiting a maximum cross-section which is small enough to prevent the bulk of said particulate washer additive and the bulk of said particulate dryer additive from passing therethrough so long as they remain in a substantially dry, solid state, said apertures in said polymeric film pouch wall also being large enough to permit said wash water to enter said pouch, dissolve said particulate washer additive and form a wash liquor which thereafter exits said pouch through said apertures during said wash cycle without dissolving said substantially water insoluble particulate dryer additive, said apertures in said polymeric film pouch wall also functioning during the tumble drying cycle to substantially uniformly distribute said dryer additive onto the surfaces of the laundered textiles which come in contact with said apertured pouch wall during the tumble drying cycle while said dryer additive is in a softened and viscous state.

26. The through the washer and dryer laundry additive product of claim 25, wherein said particulate washer additive comprises a detergent composition.

27. The through the washer and dryer laundry additive product of claim 26, wherein said particulate dryer additive comprises a softener/anti-stat composition.

28. The through the washer and dryer laundry additive product of claim 27, further including a macroscopically expanded and macroscopically apertured polymeric film layer secured intermediate said opposing pouch walls to impart greater resistance to collapse to said pouch during said tumble drying cycle.

* * * * *

UNITED STATES PATENT AND TRADEMARK OFFICE

CERTIFICATE OF CORRECTION

PATENT NO. : 4,839,076

DATED : June 13, 1989

INVENTOR(S) : K. W. Willman; June T. Brennock, D. C. O'Neill and J. B. Szkutak

It is certified that error appears in the above-identified patent and that said Letters Patent is hereby corrected as shown below:

Column 2, Attorney, Agent, or Firm - "Linmann" should read -- Linman --.

Column 10, line 5, after "softener/anti-stat" insert -- ) --.

Column 17, line 67, "or" should read -- of --. (second occurrence).

Column 18, line 7, delete "on"(second occurrence).

Column 21, line 3, "example" should read -- exemplary --.

Columns 23 and 24, line 6 of Table I, after "5" (both occurrences) insert -- ) --.

Columns 25 and 26, line 6 of Table II, after "5" (both occurrences) insert -- ) --.

Columns 27 and 28, line 5 of Table III, after "5" (both occurrences) insert -- ) --.

Signed and Sealed this

Eighth Day of May, 1990

*Attest:*

HARRY F. MANBECK, JR.

*Attesting Officer*

*Commissioner of Patents and Trademarks*